US007766456B2

(12) United States Patent
Hano et al.

(10) Patent No.: US 7,766,456 B2
(45) Date of Patent: Aug. 3, 2010

(54) ELECTROSTATIC ACTUATOR, LIQUID DROPLET DISCHARGING HEAD, METHODS FOR MANUFACTURING THEM, AND LIQUID DROPLET DISCHARGING APPARATUS

(75) Inventors: Yoshifumi Hano, Chino (JP); Masahiro Fujii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 448 days.

(21) Appl. No.: 11/761,207

(22) Filed: Jun. 11, 2007

(65) Prior Publication Data

US 2008/0296998 A1 Dec. 4, 2008

(30) Foreign Application Priority Data

Jun. 12, 2006 (JP) ..... 2006-161934
Nov. 29, 2006 (JP) ..... 2006-322145

(51) Int. Cl.
*B41J 2/04* (2006.01)

(52) U.S. Cl. ..... 347/54; 347/68; 347/70

(58) Field of Classification Search ..... 347/20, 347/54, 55, 64, 68, 70–72
See application file for complete search history.

(56) References Cited

U.S. PATENT DOCUMENTS

| | | | | |
|---|---|---|---|---|
| 4,990,939 | A * | 2/1991 | Sekiya et al. | 347/62 |
| 6,568,794 | B2 * | 5/2003 | Yamanaka et al. | 347/54 |
| 6,682,185 | B2 * | 1/2004 | Hashimoto et al. | 347/87 |

FOREIGN PATENT DOCUMENTS

| | | |
|---|---|---|
| JP | 08-118626 | 5/1996 |
| JP | 10-296973 | 11/1998 |
| JP | 2000-094696 | 4/2000 |
| JP | 2002-019129 | 1/2002 |
| JP | 2002-046282 | 2/2002 |
| JP | 2003-011359 | 1/2003 |
| JP | 2003-080708 | 3/2003 |
| JP | 2006-271183 | 10/2006 |
| JP | 2006-304379 | 11/2006 |

* cited by examiner

*Primary Examiner*—Juanita D Stephens
(74) *Attorney, Agent, or Firm*—Workman Nydegger

(57) ABSTRACT

To allow formation of an insulation film to be applied even to a glass substrate without depending on a substrate material so as to improve pressure generated by an electrostatic actuator, as well as to achieve improvement in driving stability and driving durability of the electrostatic actuator at a low cost. [Solving Means] An electrostatic actuator including an individual electrode 5 formed on a substrate, a vibration plate 6 arranged opposite to the individual electrode 5 via a predetermined gap and a driving means for causing a displacement of the vibration plate 6 by generating an electrostatic force between the individual electrode 5 and the vibration plate 6 includes an insulation film 7 provided on one or both of opposing surfaces of the fixed electrode and the movable electrode and a surface protection film 8 provided on the insulation film 7. The surface protection film 8 is made of a hard ceramic film or a hard carbon film.

8 Claims, 23 Drawing Sheets

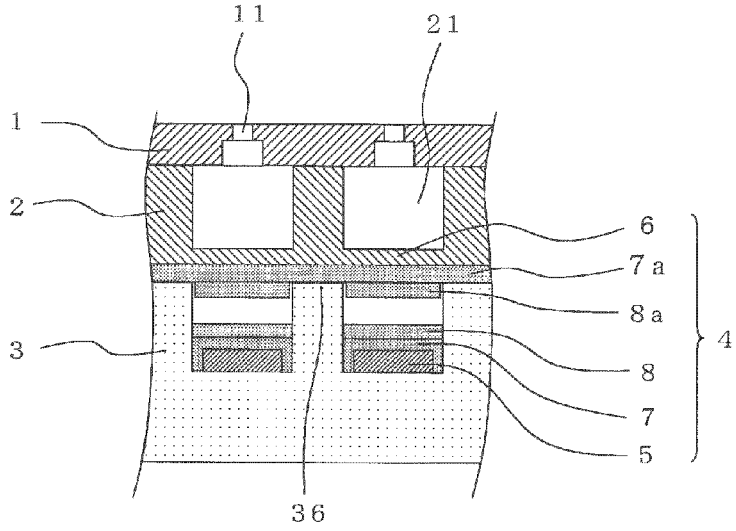
FIG.38
FIG.39(a)
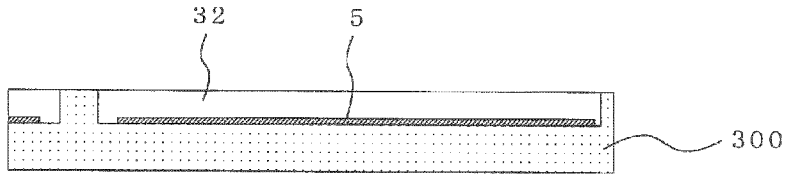
FIG.39(b)
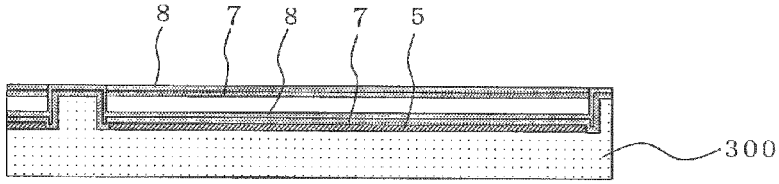
FIG.39(c)
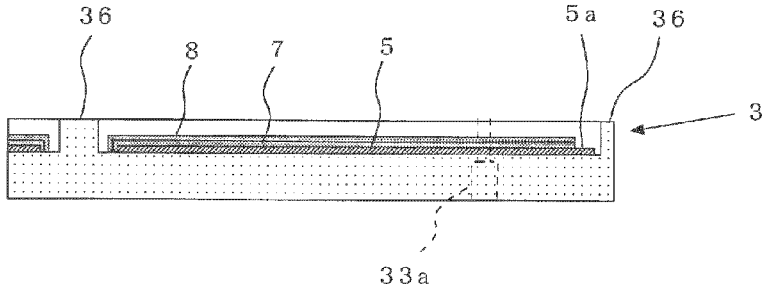

ELECTROSTATIC ACTUATOR, LIQUID DROPLET DISCHARGING HEAD, METHODS FOR MANUFACTURING THEM, AND LIQUID DROPLET DISCHARGING APPARATUS

TECHNICAL FIELD

The present invention relates to an electrostatic actuator used in an inkjet head of an electrostatically driven system or the like, a liquid droplet discharging head, methods for manufacturing them and a liquid droplet discharging apparatus.

BACKGROUND ART

As a liquid droplet discharging head for discharging liquid droplets, for example, there is known an inkjet head of electrostatically driven system that is mounted in an inkjet recording apparatus. The inkjet head of electrostatically driven system generally includes an electrostatic actuator section composed of an individual electrode (fixed electrode) formed on a glass substrate and a vibration plate (movable electrode) made of silicon arranged opposite to the individual electrode via a predetermined gap. Additionally, it includes a nozzle substrate in which a plurality of nozzle holes for discharging ink droplets are formed, a cavity substrate which is bonded to the nozzle substrate and on which an ink flow path such as an discharging chamber or a reservoir communicating with the above nozzle holes is formed between the nozzle substrate and the cavity substrate. Thereby, the inkjet head is adapted to eject an ink droplet from a selected nozzle hole by applying pressure to the discharging chamber by generating an electrostatic force in the above electrostatic actuator section.

In the conventional electrostatic actuator, for purpose of preventing insulation breakdown and short circuit of an insulation film of the actuator to ensure driving stability and driving durability, the insulation film is formed on opposing surfaces of the vibration plate and the individual electrode. As the insulation film, in general, a silicon thermal oxide film is used. The reason for that is that its manufacturing process is simple and the silicon thermal oxide film has excellent insulation-film characteristics. It is also proposed that, by a plasma CVD (Chemical Vapor Deposition) method, the insulation film made of a silicon oxide film using TEOS (tetraethoxysilane) as a raw gas is formed on the opposing surface of the vibration plate (for example, see Patent Document 1). In addition, in a case of forming the insulation film only on the vibration plate side, residual electric charge is produced inside the insulation film as a dielectric, resulting in reduction in driving stability and driving durability of the actuator. Thus, an electrostatic actuator is proposed in which an insulation film is formed on both of the vibration plate side and the individual electrode side (for example, see Patent Documents 2 and 3). Furthermore, in order to reduce the produced residual electric charge, there is proposed an electrostatic actuator in which electrode protection films made of two layers of films with high- and low-volume resistances are formed only on a surface of the individual electrode side (for example, see Patent Document 4). Moreover, an electrostatic actuator is proposed in which pressure generated by the actuator can be improved by using a dielectric material having a relative permittivity higher than silicon oxide, a so-called High-k material (high permittivity gate insulation film) for the insulation film of the actuator (for example, see Patent Document 5).

[Patent Document 1] Patent Unexamined Patent Application Publication No. 2002-19129.

[Patent Document 2] Patent Unexamined Patent Application Publication No. H8-118626.

[Patent Document 3] Patent Unexamined Patent Application Publication No. 2003-80708.

[Patent Document 4] Patent Unexamined Patent Application Publication No. 2002-46282.

[Patent Document 5] Patent Unexamined Patent Application Publication No. 2006-271183.

BRIEF DESCRIPTION OF THE DRAWINGS

FIG. 38 A m-m enlarged sectional view of FIG. 36.

FIG. 39 Sectional views for showing an outline of another manufacturing process of the electrode substrate.

DISCLOSURE OF THE INVENTION

Figure 1:
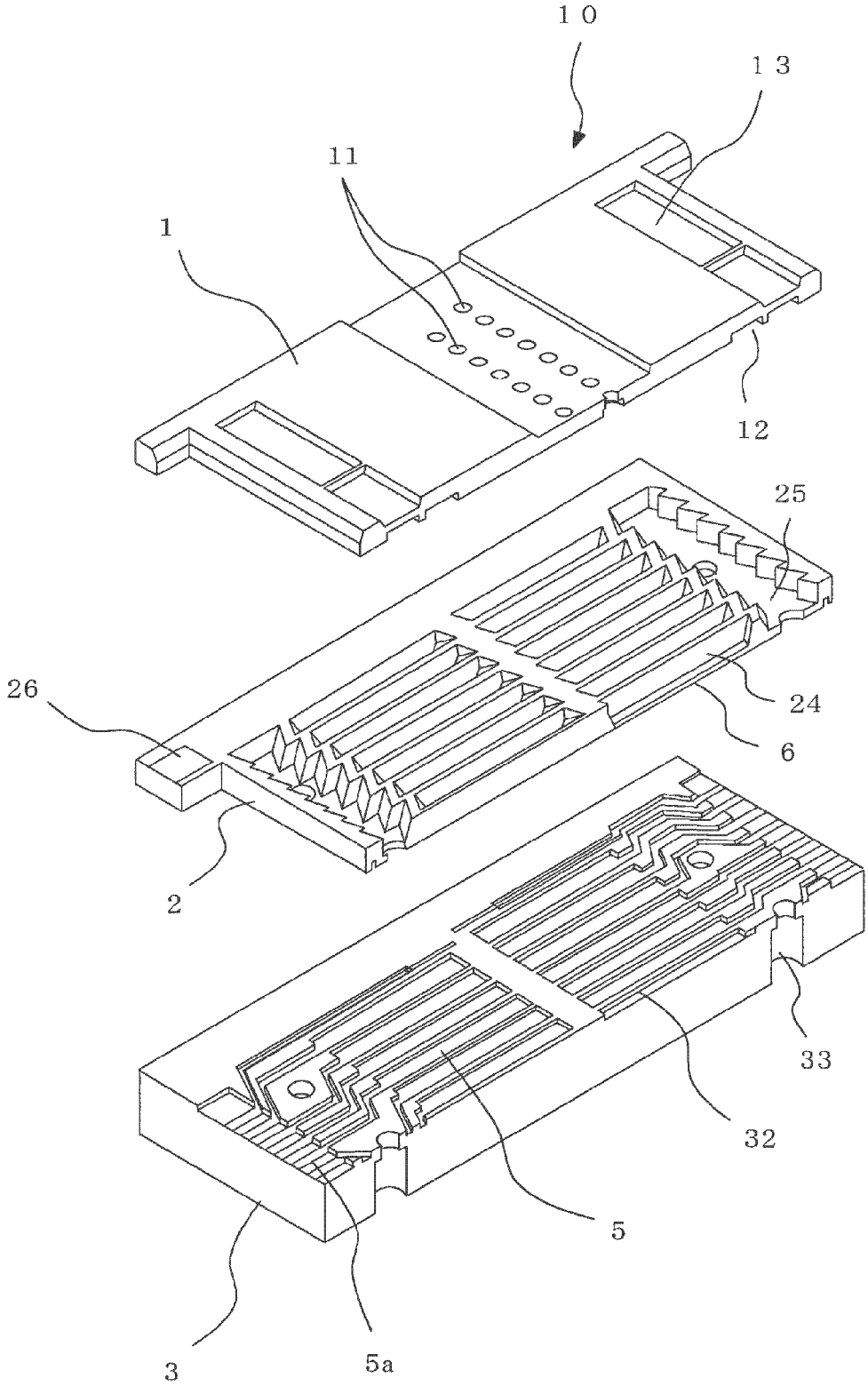
FIG. 1 An exploded perspective view for showing a schematic structure of an inkjet head according to an embodiment 1 of the present invention.

In the above conventional art, when using the silicon thermal oxide film as the insulation film of the electrode of the electrostatic actuator, there is a problem on applicability, in which its application is restricted to a silicon substrate. Thus, the silicon thermal oxide film can be formed only on the vibration plate side as a movable electrode. Meanwhile, in the case of using the TEOS film as shown in Patent Document 1, due to the CVD method used as a film manufacturing method, a large amount of carbon impurities are mixed into the film. Therefore, driving durability testing results have shown that there is often a problem with stability of the film such as abrasion of the TEOS film due to repetitive contacts between the vibration plate and the individual electrode.

In Patent Document 2, a thermal oxide film is formed on the vibration plate side and a silicon oxide film (hereinafter described as sputtered film) is formed on the individual electrode side by a sputtering method. Since a withstand voltage is low in the sputtered film, it has been necessary to increase its film thickness or additionally form a film with a good withstand voltage, such as a thermal oxide film, on the vibration plate side in order to prevent the insulation breakdown of the electrostatic actuator.

In addition, in Patent Document 3, there is provided a structure in which both electrodes of the vibration plate and the individual electrode are composed of a silicon substrate; an insulation film made of a thermal oxide film is formed not only on the vibration plate side but on the individual electrode side. In additionally, the insulation film is not formed on bonding surfaces of the silicon substrates. However, since a silicon substrate is more expensive than a glass substrate, there is a problem of cost increase.

In Patent Document 4, the electrode protection films of the two layers formed by films with high- and low-volume resistances are formed only on the individual electrode side and the vibration plate is made of a metal such as molybdenum, tungsten or nickel. However, such an insulating structure makes the structure of the electrostatic actuator complicated. Thus, its manufacturing process is complicated, resulting in high cost.

In Patent Document 5, as shown in a formula (2) which will be given below, the pressure generated by the actuator is increased by using the dielectric material with the relative permittivity higher than that of silicon oxide as the insulation film of the actuator. However, in order to drive the actuator, it is necessary to apply a voltage between electrodes. If an insulation withstand voltage of the insulation film formed on the electrodes is low, from a viewpoint of the insulation withstand voltage, a voltage applicable to the actuator is restricted to be a low voltage. Even in the actuator using a so-called High-k material as the insulation film, when an insulation withstand voltage of the High-k material is lower than that of silicon oxide, it has been difficult that the pressure generated by the actuator is improved (because an applied voltage V must be smaller than that of the formula (2) given below).

Still furthermore, as for the insulation film of the actuator, any of the above Patent Documents 1 to 5 does not disclose any combination of the so-called High-k material and a surface protection film. Especially, the surface protection film is a member for stably protecting the insulation film, as well as an element member essential in terms of maintaining a long-term driving durability of the electrostatic actuator.

Meanwhile, in the inkjet head of the electrostatically driven system including the electrostatic actuator, in recent years, as resolution has become higher, there has been an increasing demand for high density and high-speed driving. Along with that, there is a tendency that the electrostatic actuator has also been more miniaturized. In order to meet such a demand, important problems are to allow the formation of an insulation film to be applied even to a glass substrate without depending on a substrate material so as to improve the pressure generated by the actuator at a low cost and also to achieve further improvement in driving stability and driving durability of the actuator.

The present invention is intended to provide an electrostatic actuator that solves the above problems, and furthermore to provide a liquid droplet discharging head adaptable to high density and high-speed driving along with the progress toward higher resolution, methods for manufacturing them, and a liquid droplet discharging apparatus.

In order to solve the above problems, an electrostatic actuator according to the present invention including a fixed electrode formed on a substrate, a movable electrode arranged opposite to the fixed electrode via a predetermined gap and a driving means for causing a displacement of the movable electrode by generating an electrostatic force between the fixed electrode and the movable electrode includes an insulation film provided on one or both of opposing surfaces of the fixed electrode and the movable electrode, and a surface protection film provided on the insulation film. The surface protection film is made of a hard ceramic film or a hard carbon film.

In the present invention, the insulation film is formed on the fixed electrode and/or on the movable electrode, and additionally on the insulation film is formed the surface protection film made of the hard ceramic film or the hard carbon film. Thus, since the surface protection film is the hard film, even though the movable electrode repeatedly contacts the fixed electrode, the insulation film is protected by the surface protection film of the hard film. Accordingly, insulating characteristics of the insulation film can be maintained, as well as no abrasion, stripping or the like occurs because the surface protection film is the hard film. Therefore, driving stability and driving durability of the electrostatic actuator are improved.

Furthermore, it is preferable that the surface protection film may be made of a carbon material such as diamond or diamond-like carbon. In particular, it is preferable to use diamond-like carbon, since it has good adhesion to the underlying insulation film, high surface smoothness and low friction characteristics.

Additionally, when the insulation film and the surface protection film are not provided on the opposing surface of the movable electrode, it is preferable that a second insulation film may be additionally formed on the opposing surface thereof. Furthermore, also in a case in which the insulation film and the surface protection film are not provided on the opposing surface of the fixed electrode, similarly, it is preferable that the second insulation film may be formed on the opposing surface thereof. In this case, at least one of the insulation film and the second insulation film may be a silicon thermal oxide film with an excellent insulation withstand voltage and excellent film characteristics.

In this manner, the driving stability and the driving durability of the electrostatic actuator are further improved.

Additionally, at least one of the insulation film and the second insulation film may be made of a dielectric material having a relative permittivity higher than that of silicon oxide, so that pressure generated by the actuator can be improved. In this case, as the dielectric material having the relative permittivity higher than that of silicon oxide, at least one may be selected from aluminum oxide ($Al_2O_3$), hafnium oxide ($HfO_2$), hafnium silicate nitride (HfSiN) and hafnium silicate oxynitride (HfSiON). Those materials are the so-called High-k materials and have good film-deposition characteristics at low temperatures, film homogeneity, manufacturing-process adaptability and the like.

Furthermore, it is preferable that in the electrostatic actuator of the present invention, the substrate on which the fixed electrode is formed may be a glass substrate.

A method for manufacturing an electronic actuator according to the present invention is a method for manufacturing an electrostatic actuator including a fixed electrode formed on a substrate, a movable electrode arranged opposite to the fixed electrode via a predetermined gap and a driving means for causing a displacement of the movable electrode by generating an electrostatic force between the fixed electrode and the movable electrode. The method is characterized by including a step of forming the fixed electrode on a glass substrate, a step of forming an insulation film on the fixed electrode of the glass substrate, a step of forming a surface protection film made of a hard ceramic film or a hard carbon film on the insulation film, a step of anodically bonding together a silicon substrate and the glass substrate, a step of processing the silicon substrate into a thin plate, a step of etching processing from a surface opposite to a bonding surface of the silicon substrate after the anodic bonding to form the movable electrode, a step of removing water inside the gap formed between the fixed electrode and the movable electrode, and a step of hermetically sealing an open end portion of the gap.

The above manufacturing method can provide the electrostatic actuator having excellent driving stability and driving durability at a low cost.

A method for manufacturing an electronic actuator according to the present invention is a method for manufacturing an electrostatic actuator including a fixed electrode formed on a substrate, a movable electrode arranged opposite to the fixed electrode via a predetermined gap and a driving means for causing a displacement of the movable electrode by generating an electrostatic force between the fixed electrode and the movable electrode. The method is characterized by including a step of forming the fixed electrode on a glass substrate, a step of forming an insulation film on the fixed electrode of the glass substrate, a step of forming a second insulation film on a bonding surface of a silicon substrate, a step of forming a surface protection film made of a hard ceramic film or a hard carbon film on the second insulation film, a step of anodically bonding together the silicon substrate and the glass substrate, a step of processing the silicon substrate into a thin plate, a step of etching processing from a surface opposite to the bonding surface of the silicon substrate after the anodic bonding to form the movable electrode, a step of removing water inside a gap formed between the fixed electrode and the movable electrode, and a step of hermetically sealing an open end portion of the gap.

This manufacturing method can provide the electrostatic actuator having excellent driving stability and driving durability at a low cost.

In the method for manufacturing the electrostatic actuator of the present invention, for the reason described above, at least one of the insulation film and the second insulation film may be made of a silicon oxide film or a dielectric material having a relative permittivity higher than that of silicon oxide. Additionally, the surface protection film may be made of a carbon material such as diamond or diamond-like carbon. Furthermore, at least one selected from aluminum oxide ($Al_2O_3$), hafnium oxide ($HfO_2$), hafnium silicate nitride (HfSiN) and hafnium silicate oxynitride (HfSiON) is used as the dielectric material having the relative permittivity higher than that of silicon oxide.

Furthermore, since it is difficult to anodically bond the surface protection film made of the carbon material such as diamond or diamond-like carbon, the surface protection film on the bonding portion of the glass substrate may be removed. In addition, the surface protection film on the bonding portion of the silicon substrate may be removed or a silicon oxide film may be provided only on the bonding portion thereof. In this manner, bonding strength between the glass substrate and the silicon substrate can be ensured.

In addition, it is preferable that the gap may be sealed under a nitrogen atmosphere after heating and vacuuming for removing water inside the gap. As a result, since there is no water inside the gap, that is, on the insulation film and the surface protection film inside the electrostatic actuator, it can be prevented that the movable electrode remains sticking to the fixed electrode by an electrostatic force.

A liquid droplet discharging head according to the present invention is a liquid droplet discharging head including a nozzle substrate having a single or a plurality of nozzle holes for discharging a liquid droplet, a cavity substrate on which a recessed portion is formed that becomes an discharging chamber communicating with each of the nozzle holes between the nozzle substrate and the cavity substrate, and an electrode substrate on which an individual electrode as a fixed electrode is arranged opposite to a vibration plate as a movable electrode formed by a bottom portion of the discharging chamber via a predetermined gap. The liquid droplet discharging head includes any one of the above-described electrostatic actuators.

The liquid droplet discharging head of the present invention includes the electrostatic actuator having excellent driving stability and driving durability as described above. Therefore, the liquid droplet discharging head can be highly reliable and can exhibit excellent liquid droplet discharging characteristics.

A method for manufacturing a liquid droplet discharging head according to the present invention is a method for manufacturing a liquid droplet discharging head including a nozzle substrate having a single or a plurality of nozzle holes discharging a liquid droplet, a cavity substrate on which a recessed portion is formed that becomes an discharging chamber communicating with each of the nozzle holes between the nozzle substrate and the cavity substrate, and an electrode substrate on which an individual electrode as a fixed electrode is arranged opposite to a vibration plate as a movable electrode formed by a bottom portion of the discharging chamber via a predetermined gap. The manufacturing method applies any one of the above methods for manufacturing an electrostatic actuator.

In this manner, a highly reliable liquid droplet discharging head with excellent liquid droplet discharging characteristics can be manufactured at a low cost.

Additionally, a liquid droplet discharging apparatus according to the present invention includes the above liquid droplet discharging head. Therefore, an inkjet printer or the like can be realized that allows high resolution, high density and high speed performance.

Hereinafter, embodiments of a liquid droplet ejecting head including an electrostatic actuator applying the present invention will be explained based on the drawings. As an example of the liquid droplet discharging head, here will be an explanation of an inkjet head of an electrostatically driven system that is of a face discharging type discharging ink droplets from nozzle holes disposed in a surface of a nozzle substrate, by referring to FIGS. 1 to 5. However, the present invention is not restricted to structures and configurations as shown in the drawings below. The invention can be applied similarly to a four-layered structure with four substrates laminated in which an discharging chamber and a reservoir section are disposed in the separate substrates and a liquid droplet discharging head of an edge discharging type discharging liquid droplets from nozzle holes disposed at an edge of the substrate.

EMBODIMENT 1

Figure 2:
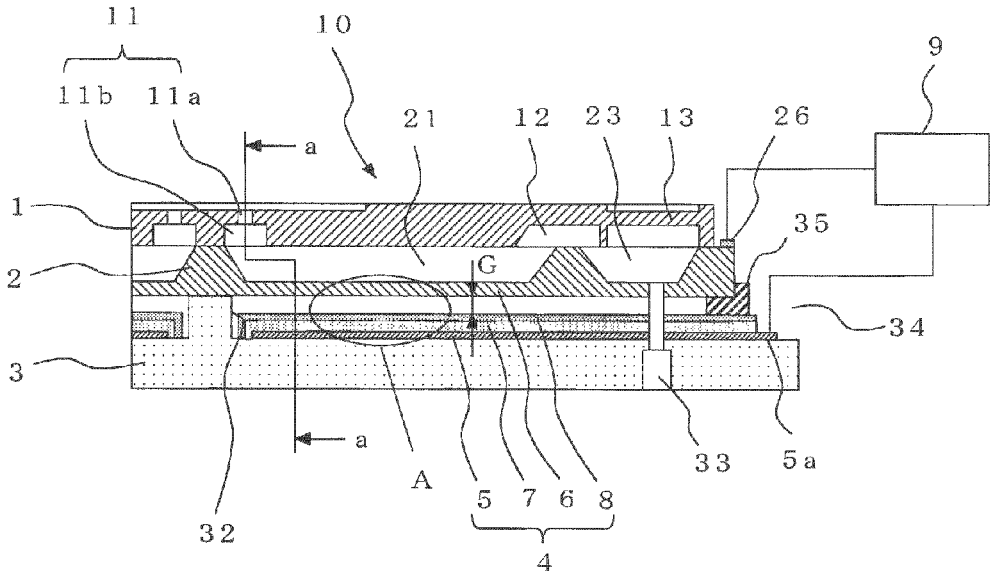
FIG. 2 A sectional view of the inkjet head for showing the schematic structure of an approximately right half of FIG. 1 in an assembly state.
Figure 3:
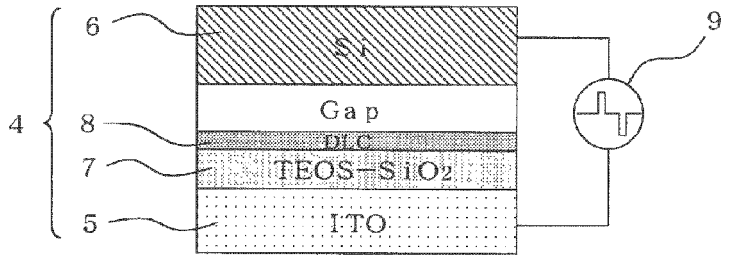
FIG. 3 An enlarged sectional view of part A of FIG. 2.
Figure 4:
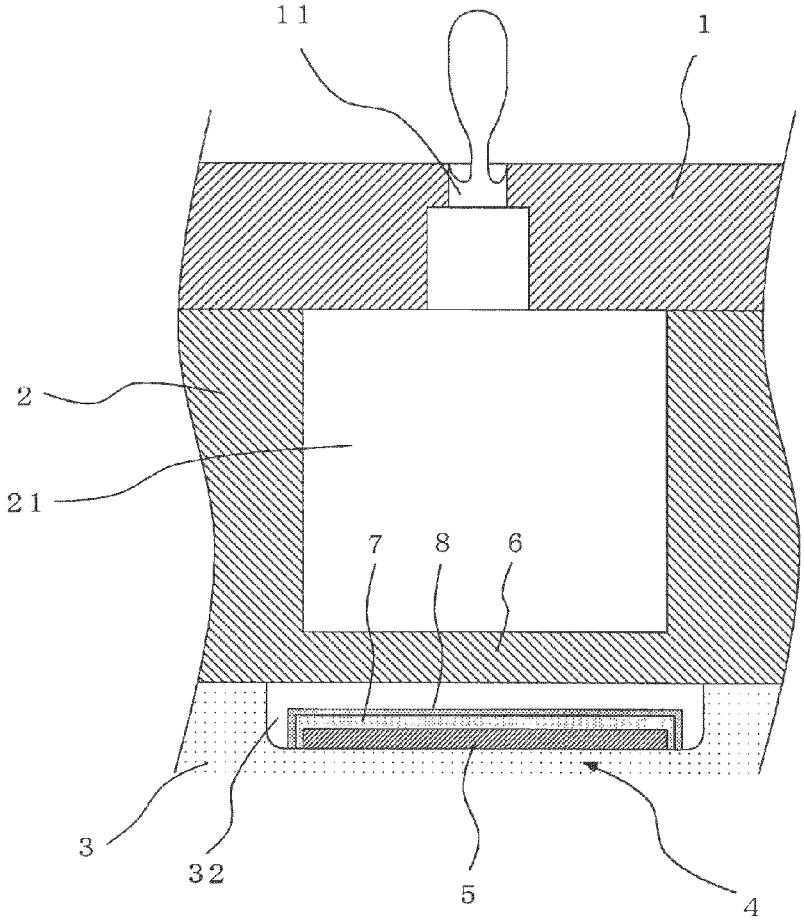
FIG. 4 An a-a enlarged sectional view of FIG. 2.
Figure 5:
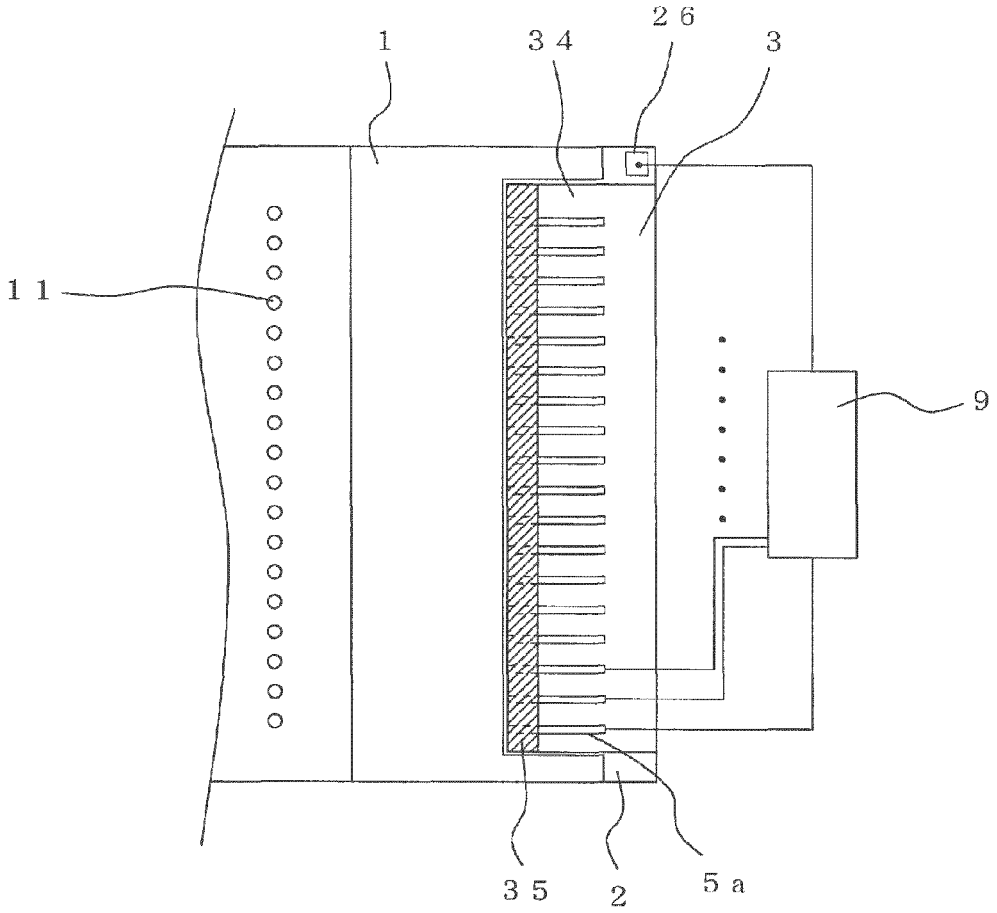
FIG. 5 A top view of the inkjet head of FIG. 2.

FIG. 1 is an exploded perspective view shown by disassembling a schematic structure of an inkjet head according to an embodiment 1, in which a part thereof is shown in section. FIG. 2 is a sectional view of the inkjet head for showing a roughly right-half schematic structure of FIG. 1 in an assembly state thereof. FIG. 3 is an enlarged sectional view of part A of FIG. 2. FIG. 4 is an a-a enlarged sectional view of FIG. 2. FIG. 5 is a top view of the inkjet head of FIG. 2. In addition, in FIG. 1 and FIG. 2, it is shown upside down from its normal orientation in use.

An inkjet head (an example of a liquid droplet discharging head) 10 of the present embodiment is configured, as shown in FIG. 1 and FIG. 2, by bonding together a nozzle substrate 1 in which a plurality of nozzle holes 11 are disposed at a predetermined pitch, a cavity substrate 2 in which an ink supply path is disposed independently for each nozzle hole 11, and an electrode substrate 3 on which an individual electrode 5 is disposed opposing a vibration plate 6 disposed on the cavity substrate 2.

An electrostatic actuator section 4 disposed for each nozzle hole 11 of the inkjet head 10 includes, as shown in FIG. 2 to FIG. 4, the individual electrode 5 as a fixed electrode that is formed inside a recessed portion 32 of the electrode substrate 3 made of glass and the vibration plate 6 as a movable electrode that is formed by a bottom wall of an discharging chamber 21 of the cavity substrate 2 made of silicon and arranged opposite to the individual electrode 5 via a predetermined gap G. On an opposing face (surface) of the individual electrode 5 is formed a silicon oxide film (hereinafter abbreviated to "TEOS-$SiO_2$ film for convenience) as an insulation film 7 by using TEOS (Tetraethoxysilane) as a raw gas under a plasma CVD (Chemical Vapor Deposition) method, for example. In addition, a surface protection film 8 is formed on the insulation film 7.

Additionally, the insulation film 7 is not restricted to the TEOS-$SiO_2$ film. It is also possible to use a dielectric material having a relative permittivity higher than that of silicon oxide ($SiO_2$), which is a so-called High-k material. As examples of the High-k material, there may be mentioned silicon oxynitride (SiON), aluminum oxide ($Al_2O_3$, alumina), hafnium oxide ($HfO_2$), tantalum oxide ($Ta_2O_3$), hafnium silicate nitride (HfSiN), hafnium silicate oxynitride (HfSiON), aluminum nitride (AlN), zirconium oxide ($ZrO_2$), cerium oxide ($CeO_2$), titanium oxide ($TiO_2$), yttrium oxide ($Y_2O_3$), zirconium silicate (ZrSiO), hafnium silicate (HfSiO), zirconium aluminate (ZrAlO), nitrogen incorporated hafnium aluminate (HfAlON), hybrid films of them and the like. Among them, when considering low-temperature film deposition of the film, homogeneity thereof, its process adaptability and the like, it is preferable to use silicon oxynitride (SiON), aluminum oxide ($Al_2O_3$, alumina), hafnium oxide ($HfO_2$), tantalum oxide ($Ta_2O_3$), hafnium silicate nitride (HfSiN) and hafnium silicate oxynitride (HfSiON).

As the surface protection film 8, it is possible to use a hard ceramic film of TiN, TiC, TiCN, TiAlN or the like, or a hard carbon film of diamond, DLC (diamond-like carbon) or the like. Particularly, it is preferable to use DLC having good adherence to the silicon oxide film as the underlying insulation film. The present embodiment 1 and each of following embodiments use DLC.

Additionally, the cavity substrate 2 made of silicon and the electrode substrate 3 made of glass are anodically bonded together directly or via the silicon oxide film. Then, as a driving means, a driving control circuit 9 such as a driver IC is wire-connected to a terminal portion 5*a* of the individual electrode 5 formed on the electrode substrate 3 and a common electrode 26 formed on a top surface opposite to a bonding surface of the cavity substrate 2, as shown in FIG. 2, FIG. 3 and FIG. 5.

In the manner explained above, the electrostatic actuator section 4 of the inkjet head 10 is formed.

Hereinafter, a structure of each substrate will be explained in more detail.

The nozzle substrate 1 is, for example, made of a silicon substrate. The nozzle hole 11 for discharging an ink droplet is, for example, composed of a nozzle hole portion formed in a two-stepped cylindrical shape having different diameters, that is, an discharging orifice portion 11*a* having a smaller diameter and an introduction orifice portion 11*b* having a diameter larger than that. The discharging orifice portion 11*a* and the introduction orifice portion 11*b* are disposed vertically with respect to the substrate surface and on the same axis, where a top end of the discharging orifice portion 11*a* is open on a surface of the nozzle substrate 1 and the introduction orifice portion 11*b* is open on a back surface (a surface on its bonding side bonded to the cavity substrate 2) of the nozzle substrate 1.

Additionally, on the nozzle substrate 1 are formed an orifice 12 communicating the discharging chamber 21 with the reservoir 23 in the cavity substrate 2 and a diaphragm section 13 for compensating pressure fluctuations of the reservoir 23 section.

Since the nozzle hole 11 is formed into the two steps by the discharging orifice portion 11*a* and the introduction orifice portion 11*b* having the diameter larger than that, an discharging direction of an ink droplet can be aligned in a central axis direction of the nozzle hole 11, whereby stable ink discharging characteristics can be exhibited. In other words, a flying direction of ink droplets does not vary and the ink droplets do not scatter around, as well as variations in discharging amounts of the ink droplets can be suppressed. Additionally, it is possible to achieve a higher nozzle density.

The cavity substrate 2 is, for example, made of a silicon substrate of a plane azimuth (110). On the cavity substrate 2 are formed a recessed portion 22 that becomes the discharging chamber 21 and a recessed portion 24 that becomes the reservoir 23 to be disposed in an ink flow path by etching. The recessed portion 22 is formed independently and in a plural number at a position corresponding to the above nozzle hole 11. Accordingly, as shown in FIG. 2, when bonding together the nozzle substrate 1 and the cavity substrate 2, each recessed portion 22 forms the discharging chamber 21 and communicates with the nozzle hole 11, as well as each communicates with the orifice 12 as an ink supplying orifice. Additionally, a bottom portion of the discharging chamber 21 (recessed portion 22) is the above vibration plate 6. Regarding the vibration plate 6, a boron diffusion layer is formed by diffusing borons (B) from the surface of the silicon substrate and an etching stop is provided by wet etching so as to finish the plate thinly with a thickness of the boron diffusion layer.

The recessed portion 24 pools a liquid material such as ink to form the reservoir (common ink chamber) 23, which is common to each discharging chamber 21. Then, the reservoir 23 (recessed portion 24) communicates with all the discharging chambers 21 via the orifice 12. In addition, in a bottom portion of the reservoir 23 is disposed a hole penetrating through the electrode substrate 3, which will be mentioned below. Through an ink supplying hole 33 of the hole, ink is supplied from an ink cartridge (not shown in the drawings).

The electrode substrate 3 is, for example, made of a glass substrate. In particular, it is suitable to use a hard borosilicate heat-resistant glass having a thermal expansion coefficient close to that of the silicon substrate as the cavity substrate 2. This is because, when the electrode substrate 3 and the cavity substrate 2 are anodically bonded together, the close thermal expansion coefficients between both substrates can reduce stress occurring between the electrode substrate 3 and the cavity substrate 2, with the result that the electrode substrate 3 and the cavity substrate 2 can be strongly bonded together without problems such as stripping.

On the electrode substrate 3 is disposed each recessed portion 32 at a surface position opposing each vibration plate 6 of the cavity substrate 6. The recessed portion 32 is formed with a predetermined depth by etching. Then, inside each recessed portion 32, in general, the individual electrode 5 made of ITO (Indium Tin Oxide) is formed, for example, with a thickness of 100 nm by sputtering. In addition, the insulation film 7 made of the TEOS-$SiO_2$ film described above is formed on the surface of the individual electrode 5, and also the surface protection film 8 made of DLC is formed on the insulation film 7, respectively with predetermined depths. Accordingly, a gap (void space) G formed between the vibration plate 6 and the individual electrode 5 will be determined by the depth of the recessed portion 32 and each thickness of the individual electrode 5, the insulation film 7 and the surface protection film 8. Since the gap G significantly influences discharging characteristics of the inkjet head, it is necessary to process the depth of the recessed portion 32 and the thicknesses of the individual electrode 5, the insulation film 7 and the surface protection film 8 with a high degree of precision.

In addition, a compound used as the surface protection film generally has a significantly large film stress with respect to the underlying insulation film. Accordingly, in order to prevent interfacial stripping between the underlying insulation film and the surface protection film, it is preferable that the film thickness of the surface protection film 8 may be made as thin as possible. Specifically, it is preferable to form the film with a thickness equal to or less than 10% with respect to the thickness of the insulation film 7.

In the present embodiment, the TEOS-$SiO_2$ film as the insulation film 7 on the individual electrode 5 is set to have a thickness of 120 nm, the DLC film as the surface protection film 8 is set to have a thickness of 5 nm and a distance of the gap G is set to be 200 nm. In addition, the thickness of the individual electrode 5 made of ITO is set to be 100 nm. Accordingly, the recessed portion 32 is etched with a depth of 425 nm.

The individual electrode 5 has the terminal portion 5*a* connected to a flexible wiring substrate (not shown in the drawings). Regarding the terminal portion 5*a*, as shown in FIG. 2 and FIG. 5, the surface protection film 8 and the insulation film 7 of the portion are removed for wiring and the terminal portion 5*a* is exposed inside an electrode extraction portion 34 where an end portion of the cavity substrate 2 is opened.

Furthermore, an open end portion of the gap G formed between the vibration plate 6 and the individual electrode 5 is sealed with a sealant 35 of resin such as epoxy. This can prevent entry of moisture, dust or the like into the gap between the electrodes, so that the inkjet head 10 can maintain its high reliability.

As described above, the nozzle substrate 1, the cavity substrate 2 and the electrode substrate 3 are bonded together to manufacture a main body section of the inkjet head 10, as shown in FIG. 2. In other words, the cavity substrate 2 and the electrode substrate 3 are bonded together by anodic bonding, and the nozzle substrate 1 is bonded to a top surface of the cavity substrate 2 (top surface thereof in FIG. 2) by adhesion or the like.

Then lastly, as shown by simplification in FIG. 2 and FIG. 5, the driving control circuit 9 such as a driver IC is connected to the terminal portion 5*a* of each individual electrode 5 and the common electrode 26 on the top surface of the cavity substrate 2 via the above flexible wiring substrate (not shown in the drawings).

In the manner as described above, the inkjet head 10 is completed.

Next, an explanation will be given of operations of the inkjet head 10 formed as above.

When a pulse voltage is applied between the individual electrode 5 and the common electrode 26 of the cavity substrate 2 by the driving control circuit 9, the vibration plate 6 is pulled toward the individual electrode 5 side and sticks thereto. Thereby the vibration plate 6 generates a negative pressure inside the discharging chamber 21 to absorb ink inside the reservoir 23 so as to cause vibration (meniscus vibration) of ink. When the voltage is released at a point in time in which the vibration of ink becomes approximately maximum, the vibration plate 6 is separated therefrom to push out ink from the nozzle 11 so as to eject an ink liquid droplet.

In that case, the vibration plate 6 sticks to the individual electrode 5 side via the insulation film 7 made of the TEOS-$SiO_2$ film formed on the individual electrode 5 and the surface protection film 8 made of DLC formed thereon. In short, the vibration plate 6 repeats abutment with and separation from the surface protection film 8 on the individual electrode 5 side. At this time, stress or the like due to the repetitive contacts acts on the surface protection film 8. However, the surface protection film 8 is made of the DLC hard film, which has good adhesion to the TEOS-$SiO_2$ film as the underlying insulation film, high surface smoothness and low friction characteristics. Thus, no stripping, abrasion or the like occur in the surface protection film 8. Accordingly, even in the case of the TEOS-$SiO_2$ film typically used as the insulation film 7 of the individual electrode 5, since its surface is protected by the DLC hard film, there is little influence on the TEOS-$SiO_2$ film. Therefore, characteristics of the TEOS-$SiO_2$ film, such as insulation and adhesion thereof, can be maintained.

Additionally, since the inkjet head 10 includes the electrostatic actuator section 4 formed as described above, even if the electrostatic actuator section 4 is miniaturized, it has excellent driving durability and driving stability, as well as high-speed driving and high density become possible.

Additionally, although the embodiment 1 has the structure in which the insulation film 7 with the surface protection film 8 thereon is formed on the fixed electrode (individual electrode) side, it may be possible to employ an opposite structure, that is, a structure in which the insulation film 7 is formed on the movable electrode (vibration plate) side and the surface protection film 8 is formed thereon. For example, when the TEOS-$SiO_2$ film or the like as the insulation film on the movable electrode is formed on the vibration plate, it is preferable to additionally a surface protection film on the insulation film. In this case, if the surface protection film is present on the bonding portion between the silicon substrate and the glass substrate, bonding strength therebetween decreases. Thus, preferably, the substrates are bonded together after partially removing the surface protection film from only the bonding portion.

EMBODIMENT 2

Figure 6:
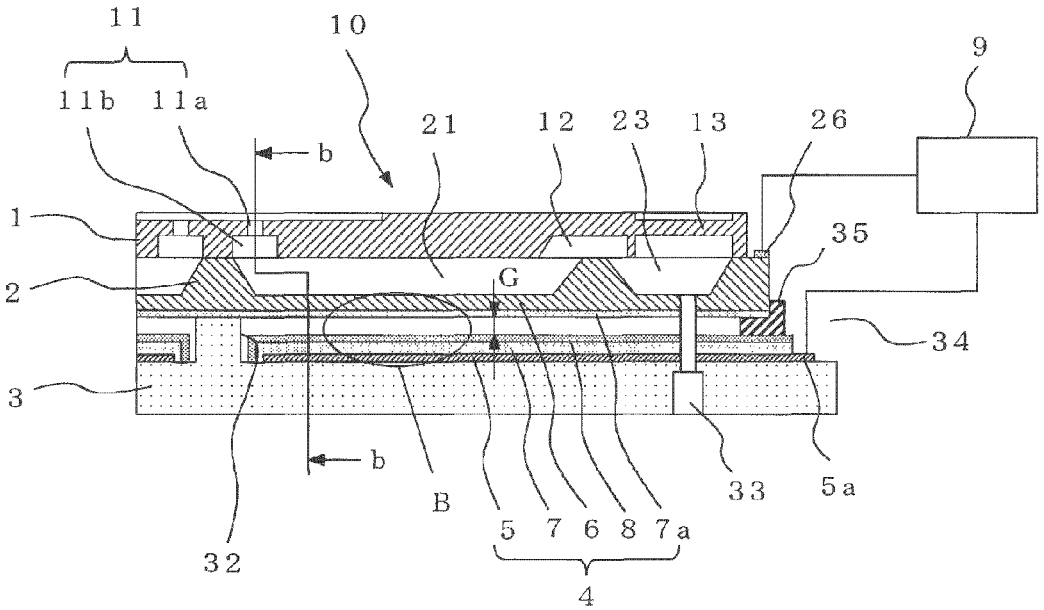
FIG. 6 A schematic sectional view of an inkjet head according to an embodiment 2 of the present invention.
Figure 7:
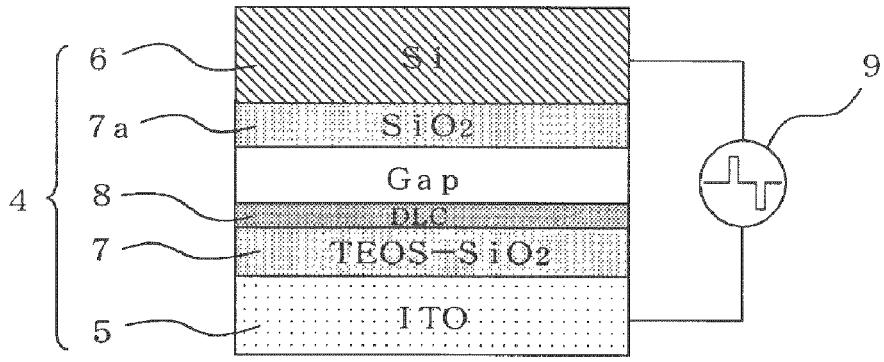
FIG. 7 An enlarged sectional view of part B of FIG. 6.
Figure 8:
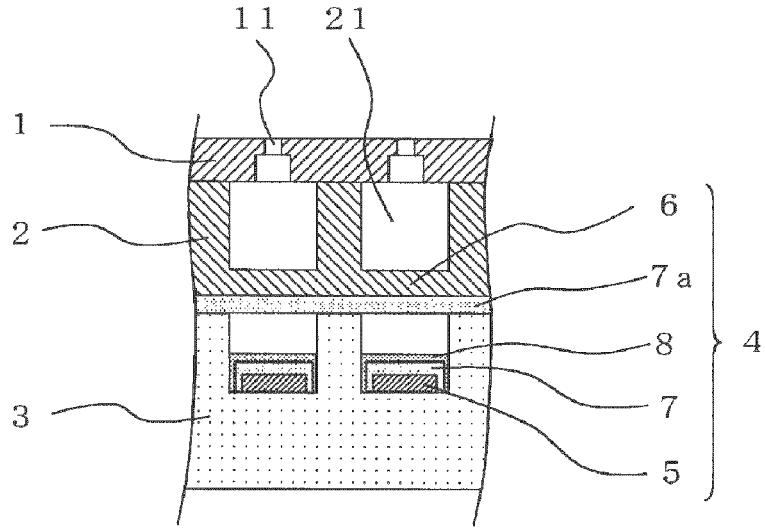
FIG. 8 A b-b enlarged sectional view of FIG. 6.

FIG. 6 is a schematic sectional view of an inkjet head 10 according to an embodiment 2 of the invention, FIG. 7 is an enlarged sectional view of part B of FIG. 6, and FIG. 8 is a b-b enlarged sectional view of FIG. 6.

In the embodiment 2, there is provided a structure of an electrostatic actuator section 4, in which a silicon thermal oxide film is formed as a second insulation film 7*a* on the vibration plate 6 side, whereas the insulation film 7 made of the TEOS—$SiO_2$ film with the surface protection film 8 made of DLC thereon is formed on the individual electrode 5 side as in the embodiment 1. The silicon thermal oxide film as the second insulation film 7*a* is formed on an entire surface of the cavity substrate 2 opposing to the side thereof bonded to the electrode substrate 3.

Regarding film thicknesses, the second insulation film 7*a* made of the silicon thermal oxide film on the vibration plate 6 side is set to have a thickness of 50 nm, the insulation film 7 made of the TEOS-$SiO_2$ film on the individual electrode 5 side is set to have a thickness of 60 nm, and the surface protection film 8 made of DLC is set to have a thickness of 5 nm. The gap G is set to have a distance of 200 nm and the individual electrode 5 has a thickness of 100 nm. The other structures are the same as those in the embodiment 1. Thus, the same reference numerals are given to corresponding parts and explanations thereof are omitted. Also in the embodiments 3 to 11 below, the same reference numerals will be used for corresponding parts.

In the embodiment 2, the silicon thermal oxide film 7*a* having an excellent insulation withstand voltage and excellent film characteristics is additionally formed on the vibration plate 6 side. Consequently, there can be obtained an electrostatic actuator that allows high-voltage driving and has excellent driving durability and driving stability.

EMBODIMENT 3

Figure 9:
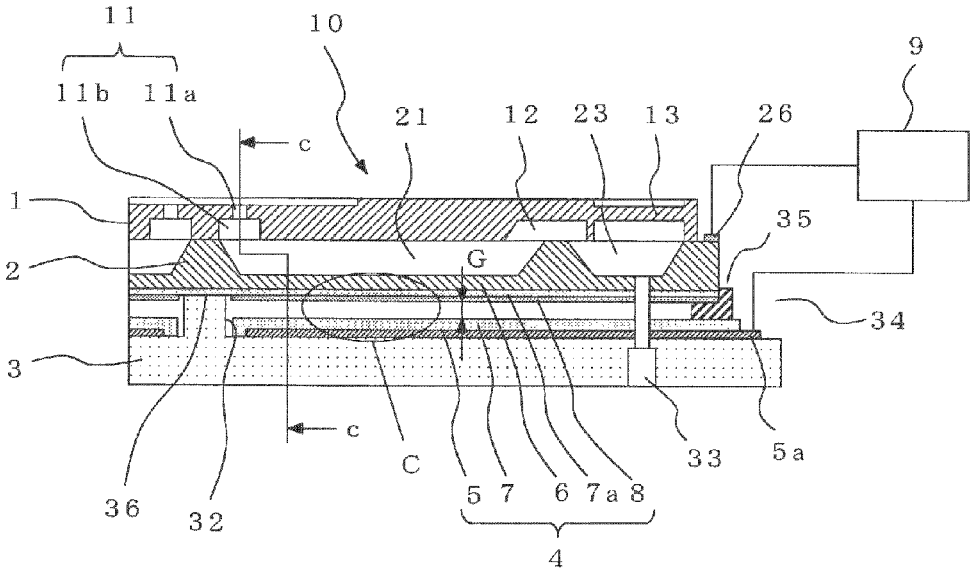
FIG. 9 A schematic sectional view of an inkjet head according to an embodiment 3 of the present invention.
Figure 10:
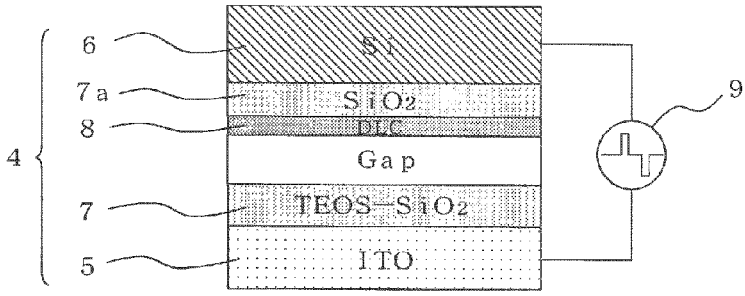
FIG. 10 An enlarged sectional view of part C of FIG. 9.
Figure 11:
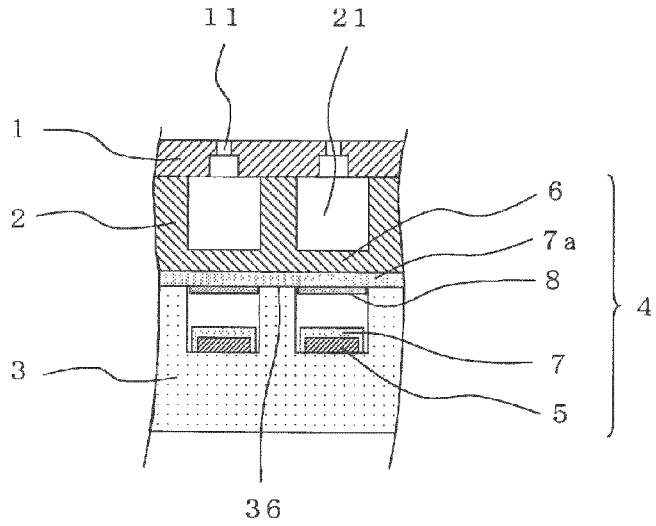
FIG. 11A c-c enlarged sectional view of FIG. 9.

FIG. 9 is a schematic sectional view of an inkjet head according to an embodiment 3 of the present invention, FIG. 10 is an enlarged sectional view of part C of FIG. 9, and FIG. 11 is a c-c enlarged sectional view of FIG. 9.

In the embodiment 3, there is provided a structure of an electrostatic actuator section 4, in which the silicon thermal oxide film is formed as the second insulation film 7*a* on the vibration plate 6 side and additionally the surface protection film 8 made of DLC is formed thereon, whereas the insulation film 7 made of the TEOS—$SiO_2$ film is formed on the individual electrode 5 side. That is, the surface protection film 8 made of DLC is formed on the silicon thermal oxide film on the vibration plate 6 side in the embodiment 2. Furthermore, since it is difficult to anodically bond the second surface protection film 8*a* made of DLC, the DLC film of a portion corresponding to a bonding portion 36 of the cavity substrate 2 and the electrode substrate 3 is removed to expose the silicon thermal oxide film as the underlying insulation film so as to perform the anodic bonding via the silicon thermal oxide film.

Regarding film thicknesses, the second insulation film 7*a* made of the silicon thermal oxide film on the vibration plate 6 side is set to have a thickness of 50 nm, the insulation film 7 made of the TEOS-$SiO_2$ film on the individual electrode 5 side is set to have a thickness of 60 nm, and the surface protection film 8 made of DLC is set to have a thickness of 5 nm. The distance of the gap G is set to be 200 nm and the individual electrode 5 has a thickness of 100 nm.

In the embodiment 3, similarly to the embodiment 2, the silicon thermal oxide film 7*a* having the excellent insulation withstand voltage and film characteristics is additionally formed on the vibration plate 6 side. Consequently, there can be obtained an electrostatic actuator that allows high-voltage driving and has excellent driving durability and driving stability.

As an advantage for disposing DLC on the vibration plate side, there is a point that as compared with glass, silicon allows formation of a smoother film over an in-plane in an even state, thereby resulting in suppressing variations in actuator characteristics inside a wafer. Furthermore, when the vibration plate is processed into a thin plate for a purpose of reduction of an abutment voltage, disposing DLC with a large stress on the vibration plate side facilitates obtaining of restitutive force necessary for separation of the vibration plate. Thus, the actuator can be driven at a low voltage, which is another advantage.

EMBODIMENT 4

Figure 12:
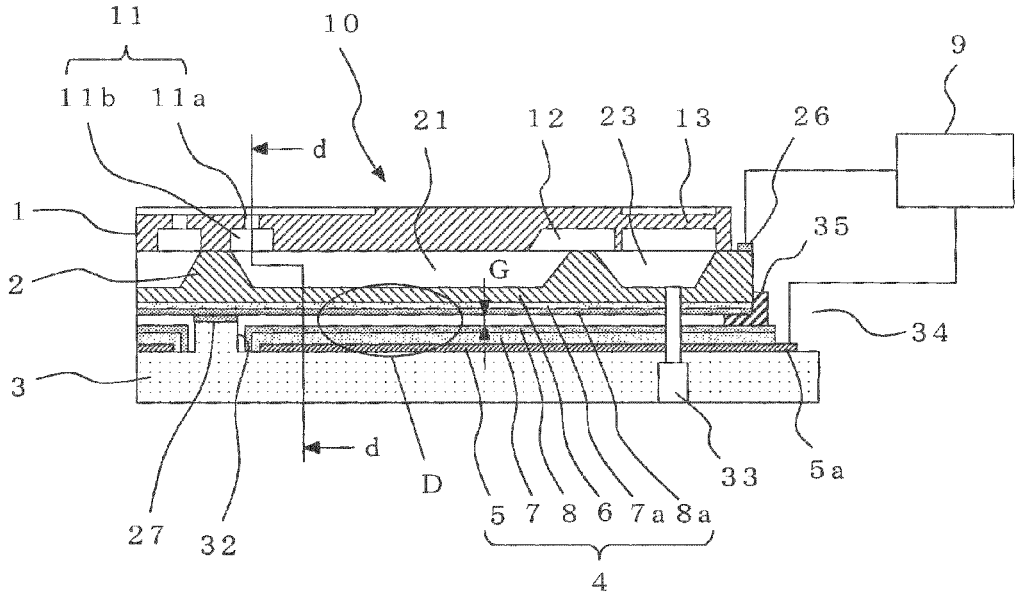
FIG. 12 A schematic sectional view of an inkjet head according to an embodiment 4 of the present invention.
Figure 13:
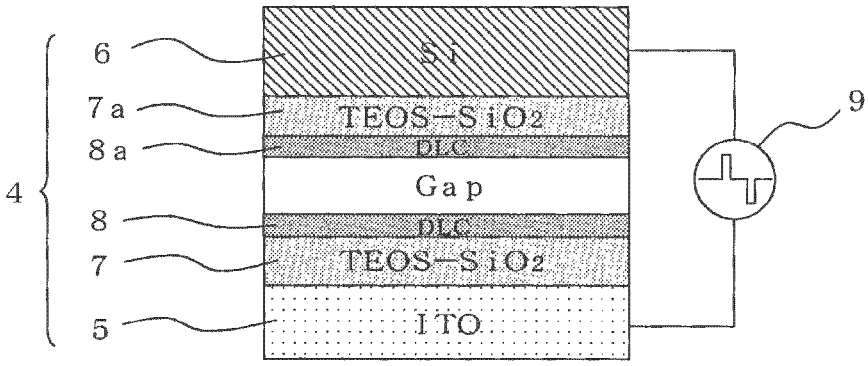
FIG. 13 An enlarged sectional view of part D of FIG. 12.
Figure 14:
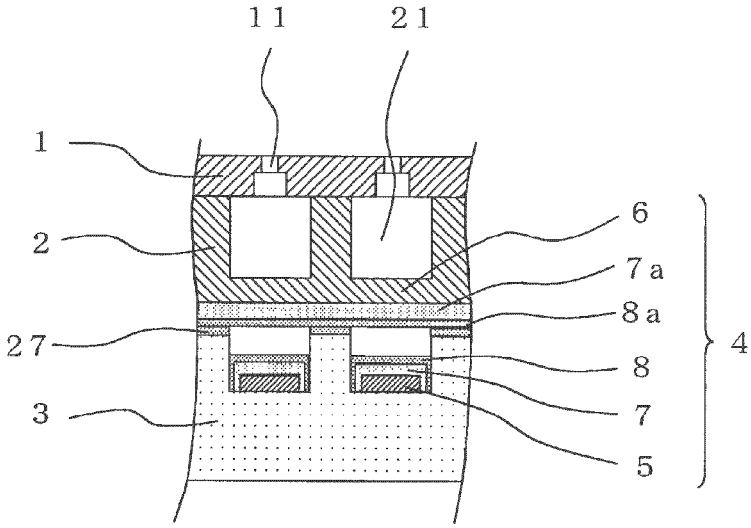
FIG. 14 A d-d enlarged sectional view of FIG. 9.

FIG. 12 is a schematic sectional view of an inkjet head 10 according to an embodiment 4 of the present invention, FIG. 13 is an enlarged sectional view of part D of FIG. 12, and FIG. 14 is a d-d enlarged sectional view of FIG. 12.

In the embodiment 4, there is provided a structure of an electrostatic actuator section 4 in which the vibration plate 6 side has also the same insulation structure as in the individual electrode 5 side of the embodiment 1. When the insulation film is formed on the vibration plate 6 side by a dielectric layer other than a silicon thermal oxide film, it is preferable to additionally form a surface protection film on the insulation film.

In the embodiment 4, the TEOS-$SiO_2$ film as the second insulation film 7*a* is formed on the vibration plate 6 side and additionally a second surface protection film 8*a* made of DLC is formed thereon. Furthermore, also in the embodiment 4, since it is difficult to anodically bond the second surface protection film 8*a* made of DLC, the DLC film on the portion corresponding to the bonding portion of the cavity substrate 2 and the electrode substrate 3 is removed to expose the underlying insulation film, or, as shown in FIG. 12 and FIG. 14, a silicon oxide film 27 is disposed only on the bonding portion so as to perform anodic bonding via the underlying insulation film or the separately added silicon thermal oxide film.

In addition, since the surface protection film formed on the opposing surface of the vibration plate is made of the same kind of DLC as the surface protection film formed on the opposing surface of the individual electrode, it is possible to suppress an increased electrostatic amount of the actuator associated with contact electrification due to driving of the actuator, thereby improving driving durability of the actuator.

Regarding film thicknesses, the second insulation film 7*a* made of the TEOS—$SiO_2$ film on the vibration plate 6 side is set to have a thickness of 50 nm, the second surface protection film 8*a* made of DLC on the individual electrode 5 side is set to have a thickness of 5 nm, the insulation film 7 made of the TEOS-$SiO_2$ film on the individual electrode 5 side is set to have a thickness of 60 nm and the surface protection film 8 made of DLC is set to have a thickness of 5 nm. The distance of the gap G is set to be 200 nm and the individual electrode 5 has a thickness of 100 nm. The other structures are the same as those in the embodiment 1 and have the same effects.

Figure 15:
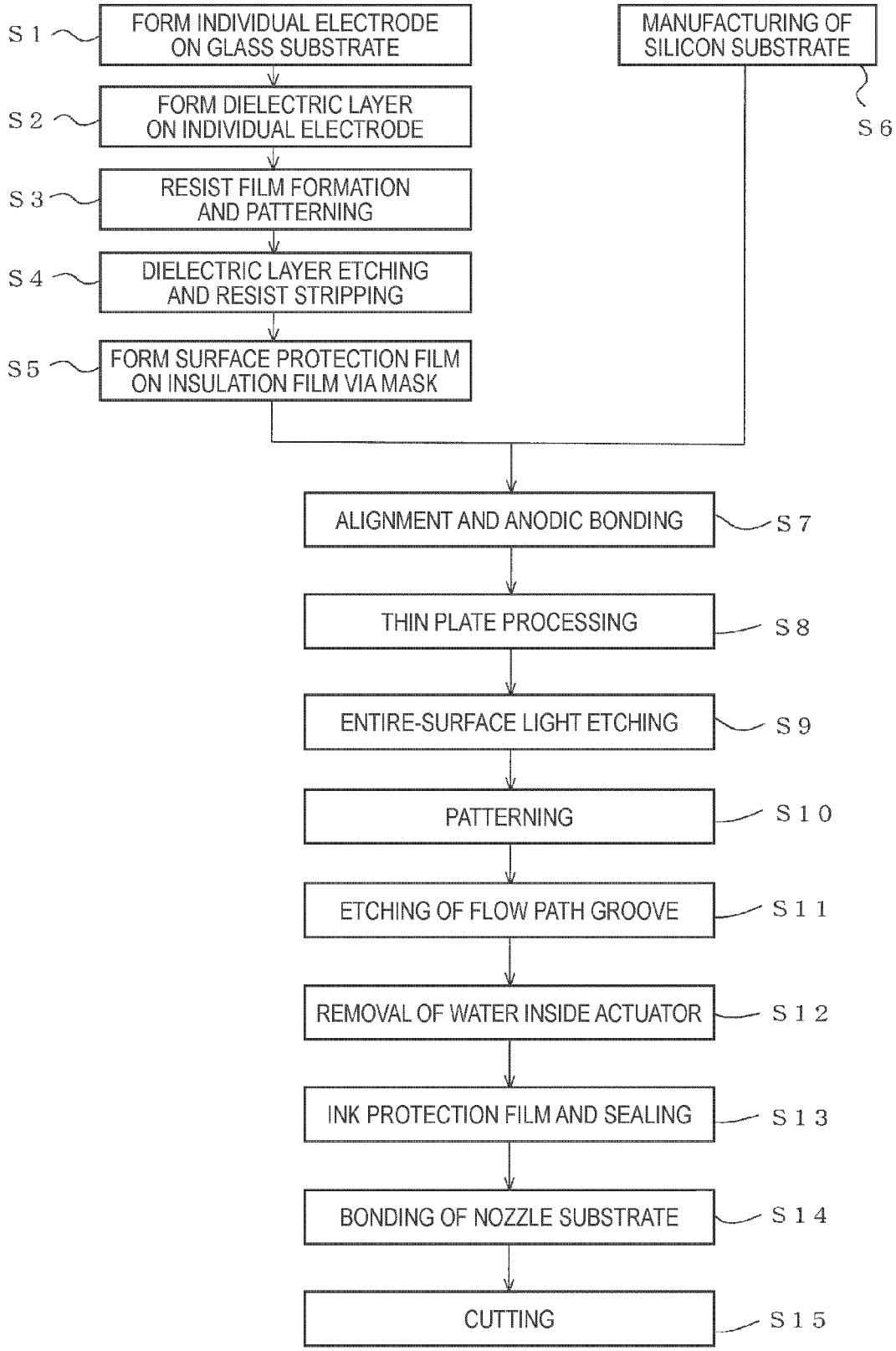
FIG. 15 A flowchart showing a schematic flow of a manufacturing process of the inkjet head.
Figure 16A:
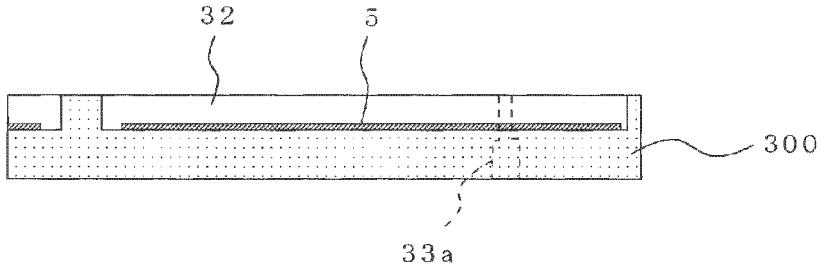
FIG. 16 Sectional views for showing an outline of a manufacturing process of an electrode substrate.
Figure 16B:
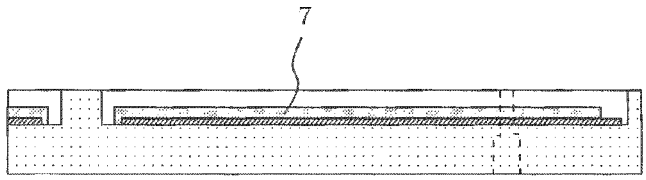
Figure 16C:
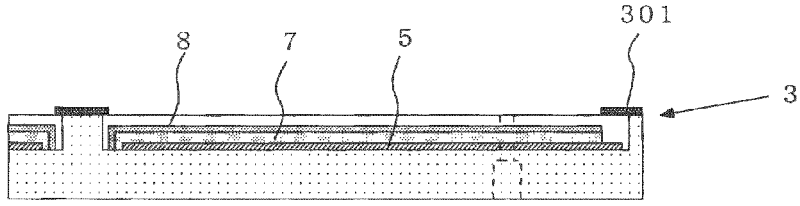
Figure 17A:
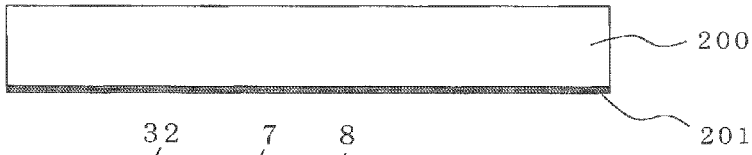
FIG. 17 Sectional views for showing an outline of a manufacturing process of the inkjet head.
Figure 17B:
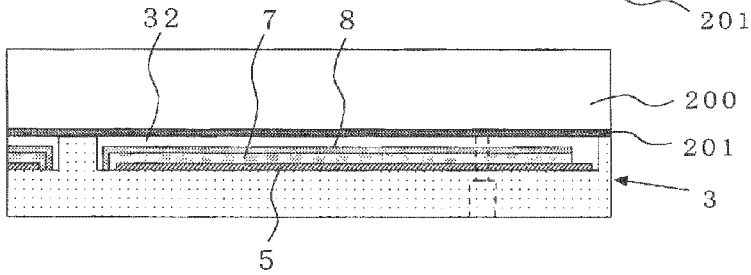
Figure 17C:
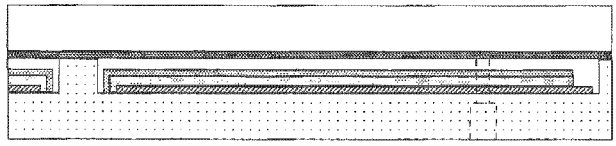
Figure 17D:
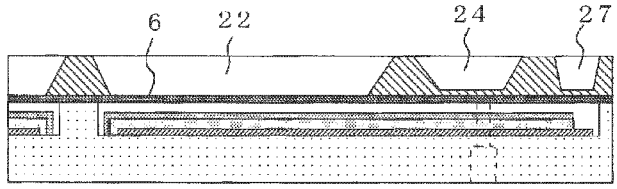
Figure 17E:
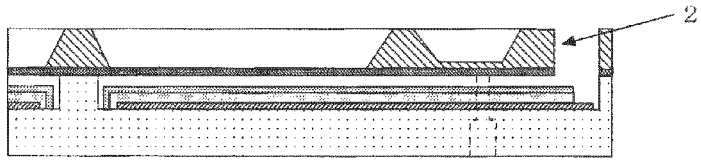
Figure 17F:
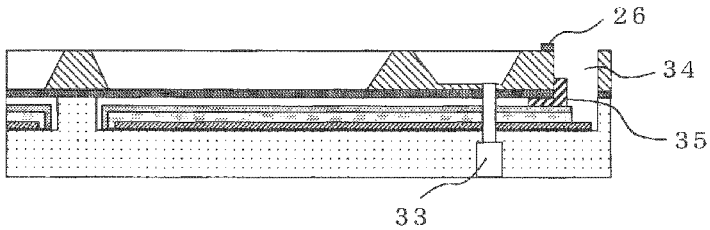
Figure 17G:
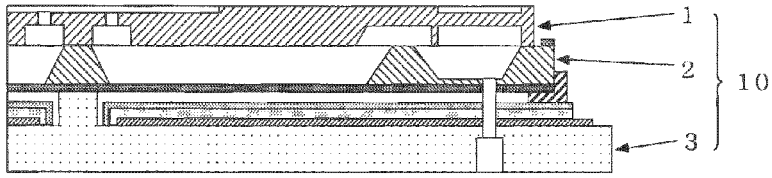

Next, an outline about an example of a manufacturing method of the above inkjet head 10 will be explained with reference to FIG. 15 to FIG. 17. FIG. 15 is a flowchart showing a schematic flow of a manufacturing process of the inkjet head 10. FIG. 16 depicts sectional views showing an outline of a manufacturing process of the electrode substrate 3. FIG. 17 depicts sectional views showing an outline of the manufacturing process of the inkjet head 10.

In FIG. 15, steps S1 to S5 show a manufacturing process of the electrode substrate 3, and step S6 shows a manufacturing process of the silicon substrate, which becomes a base of the cavity substrate 2.

Here, although an explanation will be mainly given about the manufacturing method of the inkjet head 10 shown in the embodiment 1, the other embodiments 2 to 4 will be also referred to as needed.

The electrode substrate 3 will be manufactured as below.

First, etching by fluoric acid is performed on a glass substrate 300 having a plate thickness of approximately 1 mm and made of a hard borosilicate heat-resistant glass or the like, for example, using an etching mask of gold or chrome to form the recessed portion 32 having a preferable depth. In addition, the recessed portion 32 is a groove-like portion slightly larger than a configuration of the individual electrode 31 and is formed in a plural number for each individual electrode 5.

Then, for example, an ITO (Indium Tin Oxide) film is formed with a thickness of 100 nm by a sputtering method. The ITO film is patterned by photolithography and portions except for a portion to be the individual electrode 5 are removed by etching to form the individual electrode 5 inside the recessed portion 32.

After that, a hole portion 33*a* that becomes an ink supplying hole 33 is formed by blast processing or the like (S1 of FIG. 15 and FIG. 16 (*a*)).

Next, as the insulation film 7 of the individual electrode 5, the TEOS-$SiO_2$ film using TEOS as a raw material gas is formed, for example, with a thickness of 120 nm on an entire surface of the grass substrate 300 by the plasma CVD (Chemical Vapor Deposition) method (S2 of FIG. 15). Next, patterning is performed on the TEOS-$SiO_2$ film by photolithography (S3 of FIG. 15). Then, the TEOS-$SiO_2$ film is dry-etched to form the TEOS-$SiO_2$ film on each individual electrode 5. After that, the above resist is stripped (S4 of FIG. 15 and FIG. 16 (*b*)).

Next, as shown in FIG. 16(*c*), using a silicon mask 301, a DLC film which will become the surface protection film 8 is formed, for example, with a thickness of 5 nm on the TEOS-$SiO_2$ film on each individual electrode 5 by the plasma CVD method (S5 of FIG. 15).

In the manner described above, the electrode substrate 3 is manufactured.

Additionally, in the embodiments 2 and 4, the electrode substrate 3 can be manufactured in the completely same method as above. In the case of the embodiment 3, it is only necessary to form the TEOS-$SiO_2$ film on each individual electrode 5 as described above.

The cavity substrate 2 is manufactured after a silicon substrate 200 is anodically bonded to the electrode substrate 3 manufactured by the above method.

First, for example, the silicon substrate 200 is manufactured in which a boron diffusion layer 201, for example, with a thickness of 0.8 μm is formed on an entire one-side surface of the silicon substrate 200 with a thickness of 280 μm (S6 of FIG. 15 and FIG. 17(*a*)).

In addition, in the case of the embodiment 2, the silicon substrate 200 is thermally oxidized to form a thermal oxide film with a preferable thickness on the entire substrate.

In the embodiment 3, additionally, the DLC film is deposited over an entire surface of the thermal oxide film on a bonding surface side of the silicon substrate 200, with a preferable thickness by the plasma CVD method. Thereafter, a region corresponding to the bonding portion 36 bonded to the electrode substrate 3 is patterned in a slightly large size and the DLC film of the region is removed by $O_2$ ashing to expose the thermal oxide film of the underlying insulation film.

In the embodiment 4, after the TEOS-$SiO_2$ film is formed with a preferable thickness on an entire surface of the bonding surface side of the silicon substrate 200 by the plasma CVD method, the DLC film is deposited over the entire surface thereon as described above. Then additionally, the region corresponding to the bonding portion 36 bonded to the electrode substrate 3 is patterned in a slightly large size and the DLC film of the region is removed by $O_2$ ashing to expose the TEOS-$SiO_2$ film of the underlying insulation film.

Next, the silicon substrate 200 manufactured in the method as described above is aligned on the above electrode substrate 3 to be anodically bonded thereto (S7 of FIG. 15 and FIG. 17(*b*)).

Then, the entire surface of the bonded silicon substrate 200 is polished and processed to make its thickness thin, for example, up to approximately 50 μm (S8 of FIG. 15 and FIG. 17(*c*)). Additionally, the entire surface of the silicon substrate 200 is lightly etched by wet etching to remove processed traces (S9 of FIG. 15).

Next, resist patterning is performed by photolithography on the surface of the bonded silicon substrate 200 which has been processed into the thin plate (S10 of FIG. 15) and an ink flow path groove is formed by wet etching or dry etching (S11 of FIG. 15). In this manner, the recessed portion 22 to be the discharging orifice 21, the recessed portion 24 to be the reservoir 23 and the recessed portion 27 to be the electrode extraction portion 34 are formed (FIG. 17(*d*)). In this case, since an etching stop is provided on the surface of the boron diffusion layer 201, the thickness of the vibration plate 6 can be formed with a high precision and surface roughness can be prevented.

Next, after a bottom portion of the recessed portion 27 is removed by ICP (Inductively Coupled Plasma) dry etching to open the electrode extraction portion 34 (FIG. 17(*e*)), water adhered to an inside part of the electrostatic actuator is removed (S12 of FIG. 15). The water is removed by placing the silicon substrate, for example, in a vacuum chamber and under a nitrogen atmosphere. Then, after a required time has passed, under the nitrogen atmosphere, the sealant 35 such as epoxy is applied at the open end portion of the gap to seal hermetically (S13 of FIG. 15 and FIG. 17(*f*)). In this way, after removing the adhered water inside the electrostatic actuator (inside the gap), hermetically sealing is performed. This can improve the driving durability of the electrostatic actuator.

In addition, the ink supplying hole 33 is formed by penetrating through the bottom portion of the recessed portion 24 by micro blast processing or the like. Furthermore, in order to prevent corrosion of the ink flow path groove, an ink protection film (not shown in the drawings) made of a TEOS-$SiO_2$ film is formed on the surface of the silicon substrate by the plasma CVD method. Additionally, the common electrode 26 made of a metal is formed on the silicon substrate.

The cavity substrate 2 is manufactured from the silicon substrate 200 bonded to the electrode substrate 3 through the steps as described above.

After that, the nozzle substrate 1 on which the nozzle holes 11 and the like have been formed in advance is bonded to the surface of the cavity substrate 2 by adhesion (S14 of FIG. 15 and FIG. 17(*g*)). Then finally, after cutting into individual head chips by dicing, the main body section of the inkjet head 10 described above is completed (S15 of FIG. 15).

According to the method for manufacturing the inkjet head 10 of the present embodiment, the cavity substrate 2 and the electrode substrate 3 are anodically bonded together by a direct bonding method. Thus, bonding strength therebetween can be maintained with high reliability, as well as the inkjet head including the electrostatic actuator with excellent driving durability and discharging performance can be manufactured at a low cost.

Additionally, since the cavity substrate 2 is manufactured from the silicon substrate 200 bonded to the pre-manufactured electrode substrate 3, it results that the cavity substrate 2 is supported by the electrode substrate 3. Thus, although the cavity substrate 2 is processed into a thin plate, it resists breaking and chipping, so that handling is easy. Accordingly, yield is improved more than a case of manufacturing of the cavity substrate 2 alone.

Next, embodiments 5 to 11 show a structure in which pressure generated by an electrostatic actuator is improved by using the above-mentioned so-called High-k material as an insulation film.

EMBODIMENT 5

Figure 18:
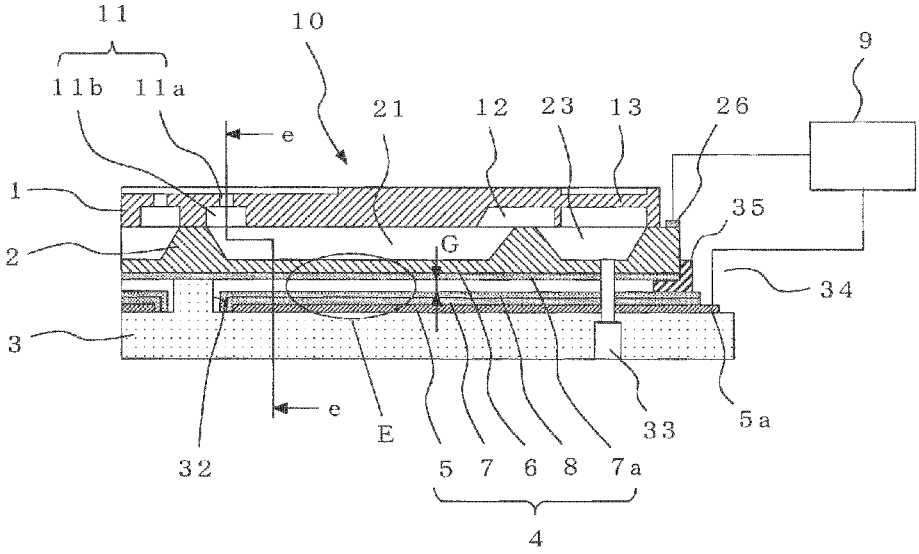
FIG. 18 A schematic sectional view of an inkjet head according to an embodiment 5 of the present invention.
Figure 19:
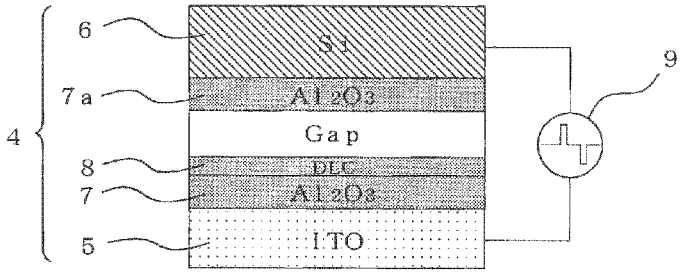
FIG. 19 An enlarged sectional view of part E of FIG. 18.
Figure 20:
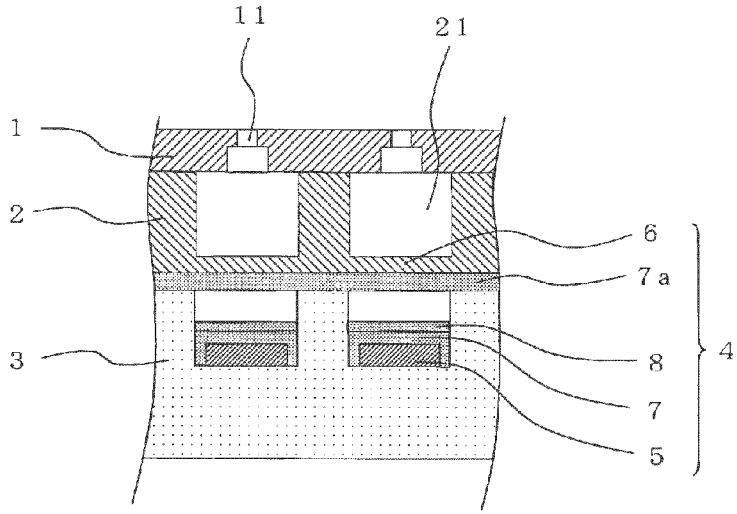
FIG. 20 An e-e enlarged sectional view of FIG. 18.

FIG. 18 is a schematic sectional view of an inkjet head according to an embodiment 5 of the present invention, FIG. 19 is an enlarged sectional view of part E of FIG. 18 and FIG. 20 is an e-e enlarged sectional view of FIG. 18.

An electrostatic actuator section 4 of the embodiment 5 has a structure in which, for example, alumina is used as both of the insulation films 7 and 7*a* on the individual electrode 5 side and the vibration plate 6 side. The surface protection film 8 made of DLC is formed on an alumina film of the individual electrode 5 side.

Regarding film thicknesses, the alumina film on the individual electrode 5 side is set to have a thickness of 40 nm, the alumina film on the vibration plate 6 side is set to have a thickness of 100 nm, and the DLC film of the surface protection film 8 is set to have a thickness of 5 nm. The distance of the gap G is set to be 200 nm and the individual electrode 5 is 100 nm in thickness.

Now, an explanation will be given about the pressure generated by the electrostatic actuator having the insulation film.

An electrostatic pressure (generated pressure) P absorbing the vibration plate 6 during a driven state will be expressed by a following formula, where an electrostatic energy is set to be E, an arbitrary position of the vibration plate 6 with respect to the individual electrode 5 is set to be x, an area of the vibration plate 6 is set to be S, an applied voltage is set to be V, the thickness of the insulation film is set to be t, the permittivity of a vacuum is set to be so and the relative permittivity of the insulation film is set to be $\in_r$:

[Equation 1]

$$P(x) = \frac{1}{S}\frac{\partial E(x)}{\partial x} = -\frac{\varepsilon_0}{2}\frac{V^2}{\left(\frac{t}{\varepsilon_r} + x\right)^2} \quad \text{(Formula 1)}$$

In addition, a mean pressure Pe during a driving of the vibration plate 6 will be expressed by a following formula, where a distance (distance of the gap) from the vibration plate 6 to the individual electrode 5 obtained when the vibration plate 6 is not driven is set to be d.

[Equation 2]

$$P_e = \frac{1}{d}\int_0^d P(x) = \frac{\varepsilon_0\varepsilon_r}{2}\frac{V^2}{t\left(\frac{t}{\varepsilon_r} + d\right)} \quad \text{(Formula 2)}$$

Then, regarding the mean pressure Pe in the electrostatic actuator with insulation films made of different materials, for example, insulation films made of two kinds of materials of alumina and hafnium oxide, when a film thickness of the alumina is $t_1$, a film thickness of the hafnium oxide is $t_2$, a relative permittivity of the alumina is $\in_1$ and a relative permittivity of the hafnium oxide is $\in_2$, a formula (3) can be introduced from the formula (2). Additionally, when a film thickness of the DLC of the surface protection film 8 is $t_3$ and a relative permittivity thereof is $\in_3$, a formula (3a) will be obtained.

[Equation 3]

$$P_e = \frac{\varepsilon_0 V^2}{2\left(\frac{t_1}{\varepsilon_1} + \frac{t_2}{\varepsilon_2}\right)\left(d + \frac{t_1}{\varepsilon_1} + \frac{t_2}{\varepsilon_2}\right)} \quad \text{(Formula 3)}$$

or $$P_e = \frac{\varepsilon_0 V^2}{2\left(\frac{t_1}{\varepsilon_1} + \frac{t_2}{\varepsilon_2} + \frac{t_3}{\varepsilon_3}\right)\left(d + \frac{t_1}{\varepsilon_1} + \frac{t_2}{\varepsilon_2} + \frac{t_3}{\varepsilon_3}\right)} \quad \text{(Formula 3a)}$$

The above formula (2) shows that, as the relative permittivity of the insulation film becomes larger or as a ratio (t/∈) of the relative permittivity of the insulation film to the thickness thereof becomes smaller, the mean pressure Pe becomes higher. Thus, when the High-k material having a relative permittivity higher than silicon oxide is applied as the insulation film, a generated pressure in the electrostatic actuator can be increased.

Additionally, in the case of the inkjet head 10 applying the High-k material as the insulation film, it is possible to obtain power necessary for discharging of ink droplets even when an area of the vibration plate 6 is small. Consequently, its resolution can be increased by reducing a width of the vibration plate 6 in the inkjet head 10 and making small a pitch of the discharging chamber 21, that is, a pit of the nozzle 11. Thus, the inkjet head 10 obtained can perform high-precision printing at a high speed. Furthermore, by reducing a length of the vibration plate 6, responsiveness of the ink flow path can be improved so as to increase a driving frequency, which enables higher-speed printing.

In addition, for example, when relative permittivities of the insulation films 7 and 7*a* are set to be doubled as a whole, approximately the same generated pressure can be obtained even if thicknesses thereof are set to be doubled. Thus, it turns out that strength against dielectric breakdown such as TDDB (Time Dependent Dielectric Breakdown: long-hour dielectric breakdown strength) or TZDB (Time Zero Dielectric Breakdown: instantaneous dielectric breakdown strength) in the electrostatic actuator can be approximately doubled.

Table 1 shows characteristics of different insulation films and a surface protection film applied in the embodiments 5 to 11 of the present invention. Based on Table 1, alumina ($Al_2O_3$) and hafnium oxide ($HfO_2$) both have a relative permittivity that is significantly greater than silicon oxide ($SiO_2$). Thus, using the high dielectric material such as alumina or hafnium oxide as the insulation film can improve the pressure generated by the electrostatic actuator.

TABLE 1

<Comparison of Insulation Film Characteristics>

| Insulation Film | Relative Permittivity | Insulation Withstand Voltage | Bonding Strength |
|---|---|---|---|
| $SiO_2$ | 3.8 | 8 MV/cm | Excellent |
| $Al_2O_3$ | 7.8 to 8 | 6 MV/cm | Moderate |
| $HfO_2$ | 18.0 to 24 | 4 MV/cm | Poor |
| DLC | 3 to 5 | 1 MV/cm or below | Poor |

Additionally, based on the above formulas (2) and (3), a parameter relating to the improvement in the pressure generated by the electrostatic actuator is a ratio ($t/\in$) of a relative permittivity of the insulation film to a thickness thereof, and the parameter in the case of a plurality kinds of insulation films is a sum ($t_1/\in_1+t_2/\in_2$) of the ratios of relative permittivities of the insulation films to thicknesses thereof. Thus, a calculated value of the parameter is shown in Table 2.

TABLE 2

| | Conventional Example ($SiO_2$: 110 nm) | Embodiments 5 and 6 ($Al_2O_3$: 140 nm, DLC: 5 nm) |
|---|---|---|
| $t/\epsilon$ ($t_1/\epsilon_1 + t_2/\epsilon_2$) | 28.95 | 19.20 |

Table 2 shows the cases of a conventional example and the embodiment 5. In the Table 2, each subscript 1 of t and $\in$ indicates alumina and each subscript 2 thereof indicates DLC. In the conventional example, as the insulation film, silicon oxide only is formed with a thickness of 110 nm. In the embodiment 5, as described above, the alumina film on the individual electrode 5 side is 40 nm in thickness, the alumina film on the vibration plate 6 side is 100 nm in thickness, and thus a total film thickness of the alumina films is 140 nm. Additionally, the DLC film as the surface protection film 8 is 5 nm in thickness. Furthermore, in the embodiment 5 and the subsequent embodiments, the relative permittivity was calculated by setting silicon oxide to be 3.8, alumina to be 7.8, hafnium oxide to be 18.0 and DLC to be 4.0.

The electrostatic actuator of the embodiment 5 has, as described above, the structure in which, as the insulation films 7 and 7*a*, the alumina film of the high dielectric material is formed on both of the individual electrode 5 side and the vibration plate 6 side. Thus, when compared with the conventional electrostatic actuator with a silicon oxide film only disposed, the actuator provides following effects:

(1) Pressure generated by the actuator is improved.

Using alumina as the high dielectric material can reduce the value of $t/\in$ as shown in the Table 2, which can improve the generated pressure in the actuator.

(2) An insulation withstand voltage can be ensured.

Since the alumina film is formed with the sufficient thickness, a required insulation withstand voltage can be ensured.

(3) Bonding strength can be ensured.

By forming the alumina film on the bonding surface of the silicon substrate, bonding strength minimally required as an actuator can be ensured.

(4) Driving durability is improved.

Using the DLC film as the surface protection film can significantly improve driving durability.

Additionally, in the case of forming the DLC film, as in the embodiment 5, it is preferable to form it on the glass substrate forming the electrode substrate 3. The reason for that is twofold as follows:

(a) Since the DLC film has a low bonding strength, it is necessary to remove the DLC film on the bonding portion of the cavity substrate 2 and the electrode substrate 3 (glass substrate). In the removal of the DLC film, patterning is required. Patterning is easier on the DLC film formed on the glass substrate and the film can be removed more surely and simply.

(b) Since the DLC film has a high film stress, formation of the DLC film on the vibration plate side of a thin film bends the vibration plate. Thus, even if an abutment voltage necessary for abutment of the vibration plate is applied, the vibration plate cannot partially abut. Meanwhile, in the case of forming the DLC film on the glass substrate side, the thick glass is present under the insulation film and the ITO film. Accordingly, when compared with the formation of the DLC film on the vibration plate side, there is less influence of stress.

A further explanation will be given for the above (a). For example, in the case of forming the DLC film on the vibration plate side, extremely high precision patterning is necessary to completely remove the DLC film on the bonding portion. If the DLC film can be removed only in a range narrower than an area of the bonding portion, due to the DLC film slightly left without being removed, the bonding strength in the actuator can be partially reduced.

In addition, when the DLC film is removed in a range wider than the area of the bonding portion, there may be formed a portion where the insulation film is exposed, which directly contacts the surface of the individual electrode as the partner. Consequently, due to stress concentration on the vibration plate or the like, lifespan of the actuator may be locally shortened.

Meanwhile, in the case of forming the DLC film on the glass substrate side, in order to completely remove the DLC film on the bonding portion, patterning is only needed for its complete removal. Moreover, since the individual electrode is provided at a lower position below the surface, the DLC film is easily removed. Accordingly, the bonding strength in the actuator can be more surely and more simply ensured.

Consequently, when using the DLC film as the surface protection film, preferably, the DLC film is formed on the glass substrate side.

Furthermore, as shown in each drawing of the embodiment 1 and the subsequent embodiments, the DLC film is individually formed on the surface of the insulation film 7 on the opposing surface of each individual electrode 5 or/and on the surface of the second insulation film 7*a* on the opposing surface of each vibration plate 6.

EMBODIMENT 6

Figure 21:
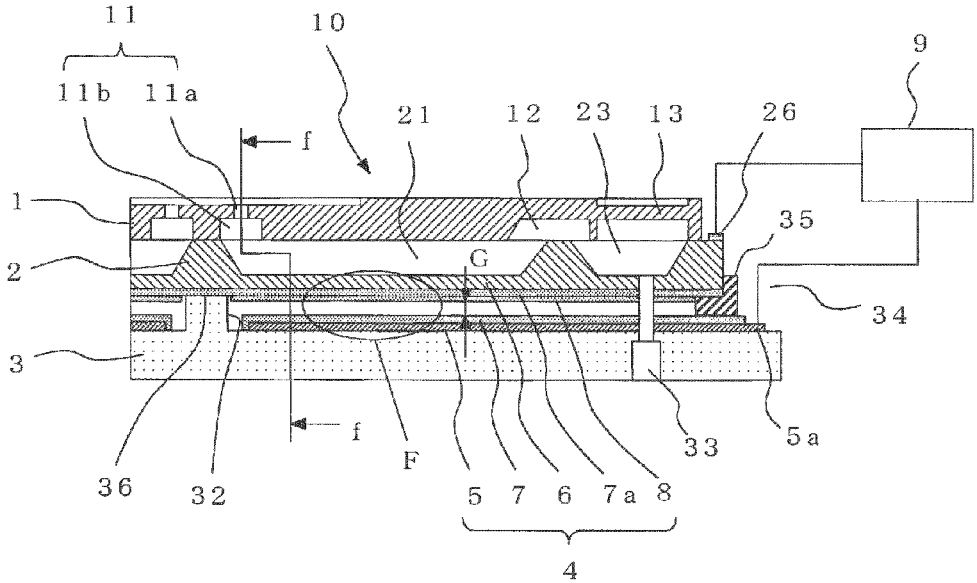
FIG. 21 A schematic sectional view of an inkjet head according to an embodiment 6 of the present invention.
Figure 22:
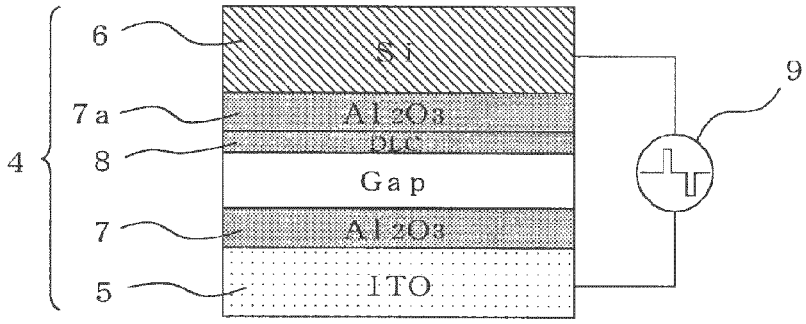
FIG. 22 An enlarged sectional view of part F of FIG. 21.
Figure 23:
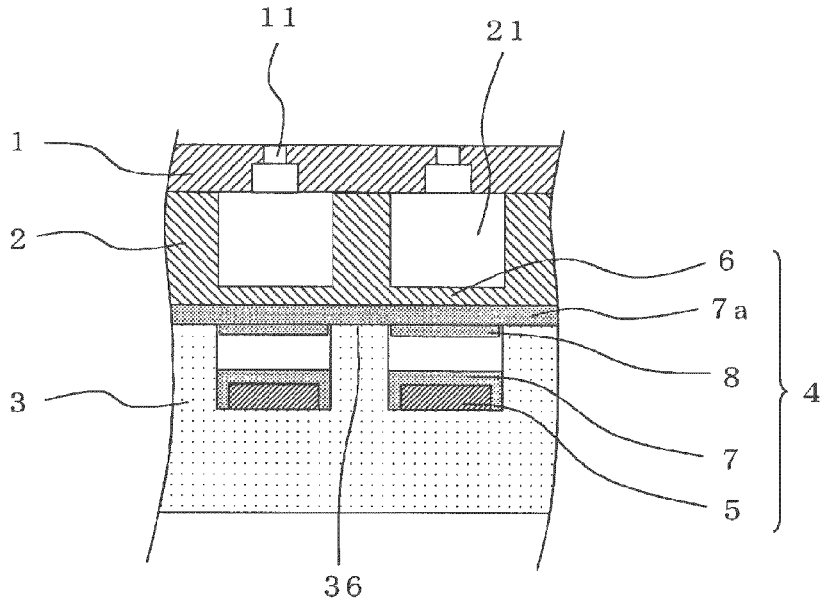
FIG. 23 An f-f enlarged sectional view of FIG. 21.

FIG. 21 is a schematic sectional view of an inkjet head 10 according to an embodiment 6 of the present invention, FIG. 22 is an enlarged sectional view of part F of FIG. 21 and FIG. 23 is an f-f enlarged sectional view of FIG. 21.

An electrostatic actuator section 4 of the embodiment 6 has the same insulating structure as that in the embodiment 5, in which alumina is used as both of the insulation films 7 and 7*a* on the individual electrode 5 side and the vibration plate 6 side. The surface protection film 8 made of DLC is formed on the alumina film on the vibration plate 6 side.

The film thicknesses are the same as those in the embodiment 5, in which the alumina film on the individual electrode 5 side is set to be 40 nm in thickness, the alumina film on the vibration plate 6 side is set to be 100 nm in thickness and the DLC film of the surface protection film 8 is set to be 5 nm in thickness. The distance of the gap G is set to be 200 nm. The individual electrode 5 has a thickness of 100 nm.

A calculated value of the parameter (the ratio of a relative permittivity of the insulation film to a thickness thereof relating to improvement in the pressure generated by the electrostatic actuator of the embodiment 6 is shown in the above Table 2.

Accordingly, the embodiment 6 can provide the same effects as those in the embodiment 5 in terms of the pressure generated by the actuator, the insulation withstand voltage, the bonding strength and the driving durability.

As an advantage for disposing DLC on the vibration plate side, there is a point that as compared with glass, silicon allows formation of a smoother film over an in-plane in an even state, thereby resulting in suppressing variations in actuator characteristics inside a wafer. Furthermore, when the vibration plate is processed into a thin plate for a purpose of reduction of an abutment voltage, disposing DLC with a large stress on the vibration plate side facilitates obtaining of a restitutive force necessary for separation of the vibration plate. Thus, the actuator can be driven at a low voltage, which is another advantage.

EMBODIMENT 7

Figure 24:
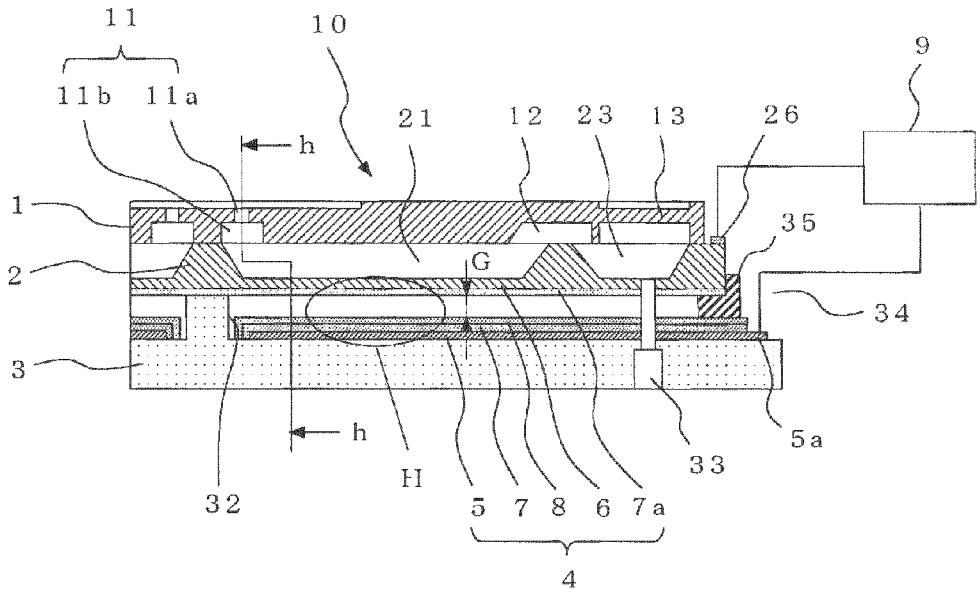
FIG. 24 A schematic sectional view of an inkjet head according to an embodiment 7 of the present invention.
Figure 25:
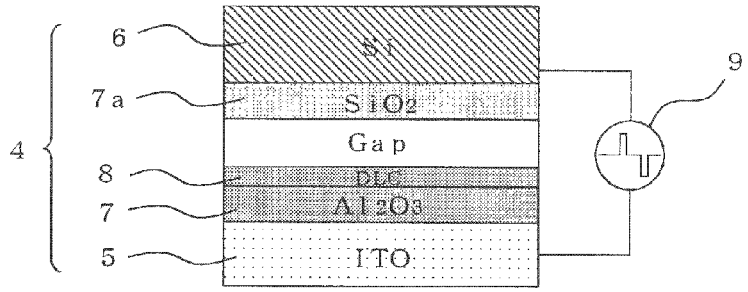
FIG. 25 An enlarged sectional view of part H of FIG. 24.
Figure 26:
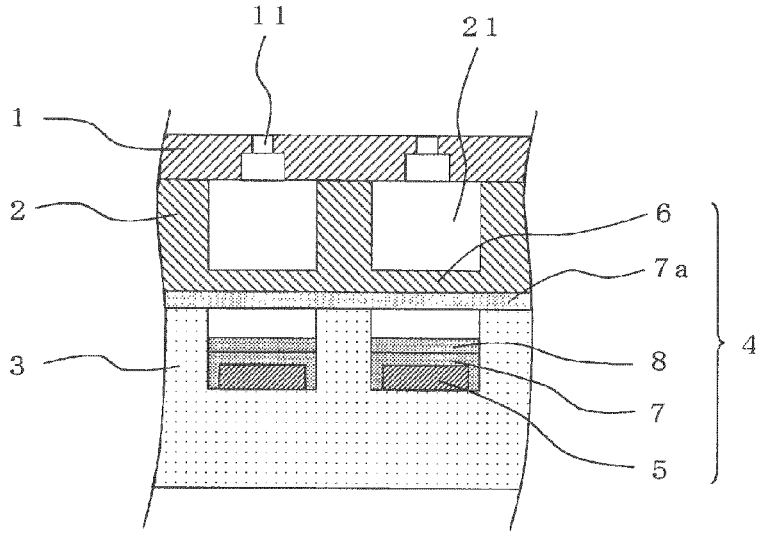
FIG. 26 An h-h enlarged sectional view of FIG. 24.

FIG. 24 is a schematic sectional view of an inkjet head 10 according to an embodiment 7 of the present invention, FIG. 25 is an enlarged sectional view of part H of FIG. 24, and FIG. 26 is an h-h enlarged sectional view of FIG. 24.

In an electrostatic actuator section 4 of the embodiment 7, a thermal oxide film of silicon ($SiO_2$ film) is formed as the second insulation film 7*a* on the vibration plate 6 side. As the insulation film 7 on the individual electrode 5 side, an alumina film is formed as in the embodiment 5 and additionally the surface protection film 8 made of DLC is formed thereon.

Regarding film thicknesses, the alumina film on the individual electrode 5 side is set to be 40 nm in thickness, the silicon thermal oxide film on the vibration plate 6 side is set to be 80 nm in thickness and the DLC film of the surface protection film is set to be 5 nm in thickness. The distance of the gap G is set to be 200 nm and the individual electrode 5 has a thickness of 100 nm.

A calculated value of the parameter (the ratio of a relative permittivity of the insulation film to a thickness thereof relating to the improvement in the pressure generated by the electrostatic actuator of the embodiment 6 is shown in the above Table 3. In the Table 3, each subscript 1 of t and ∈ indicates silicon oxide and each subscript 2 indicates alumina and each subscript 3 indicates DLC. The conventional example is the same as that in the Table 2.

TABLE 3

| | Conventional Example ($SiO_2$: 110 nm) | Embodiments 7 and 8 ($SiO_2$: 80 nm, $Al_2O_3$: 40 nm, DLC: 5 nm) |
|---|---|---|
| $t/\epsilon$ $(t_1/\epsilon_1 + t_2/\epsilon_2 + t_3/\epsilon_3)$ | 28.95 | 27.43 |

In the electrostatic actuator of the embodiment 7, the insulation film 7 on the individual electrode 5 side is made of the alumina film. Therefore, similarly to the embodiment 5, the pressure generated by the actuator can be improved.

Regarding the insulation withstand voltage, since the silicon thermal oxide film having the excellent insulation withstand voltage is disposed with the sufficient thickness, it is possible to ensure a necessary insulation withstand voltage.

Regarding the bonding strength, due to bonding between the silicon oxides, bonding strength equivalent to that of the conventional electrostatic actuator can be ensured.

Regarding the driving durability, since the DLC is used as the surface protection film, the driving durability can be significantly improved as in the embodiment 5.

EMBODIMENT 8

Figure 27:
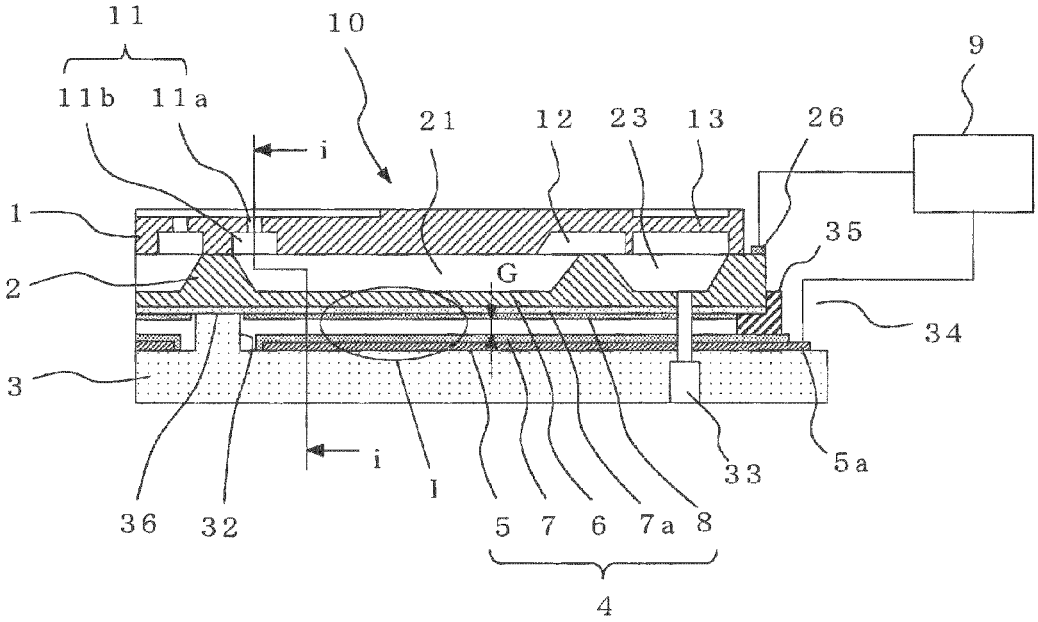
FIG. 27 A schematic sectional view of an inkjet head according to an embodiment 8 of the present invention.
Figure 28:
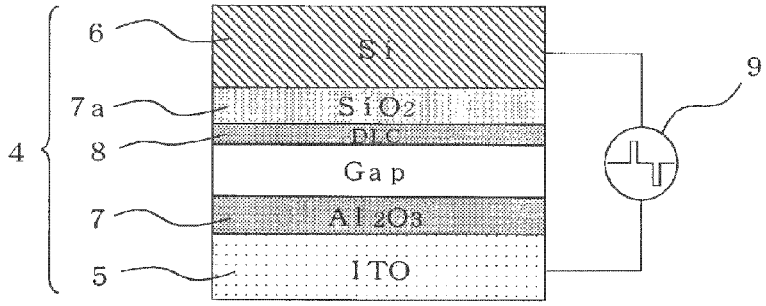
FIG. 28 An enlarged sectional view of part I of FIG. 27.
Figure 29:
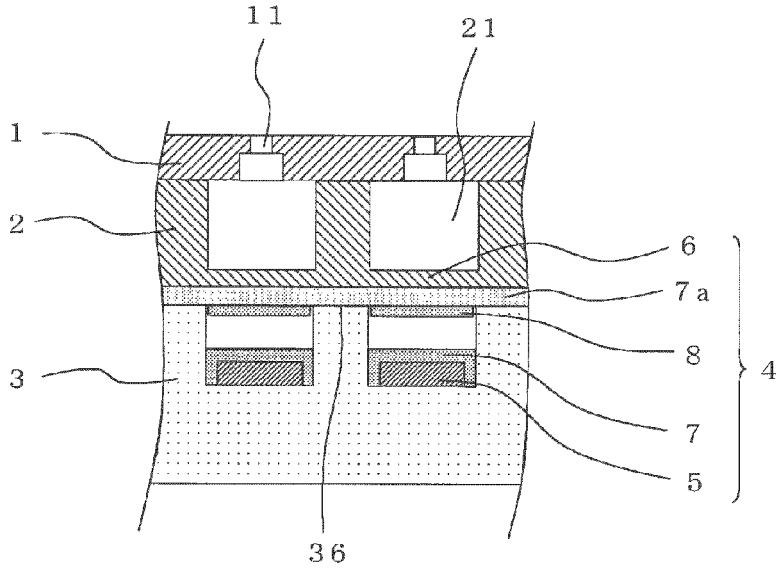
FIG. 29 An i-i enlarged sectional view of FIG. 27.

FIG. 27 is a schematic sectional view of an inkjet head 10 according to an embodiment 8 of the present invention, FIG. 28 is an enlarged sectional view of part I of FIG. 27 and FIG. 29 is an i-i enlarged sectional view of FIG. 27.

An electrostatic actuator section 4 of the embodiment 8 has the same insulating structure as that in the embodiment 7, in which the second insulation film 7*a* on the vibration plate 6 side is formed with a silicon thermal oxide film ($SiO_2$ film), whereas the insulation film 7 on the individual electrode 5 side is formed with an alumina film. The surface protection film 8 made of DLC is formed on the silicon thermal oxide film on the vibration plate 6 side.

The film thicknesses are the same as those in the embodiment 7, in which the alumina film on the individual electrode 5 side is set to be 40 nm in thickness, the silicon thermal oxide film on the vibration plate 6 side is set to be 80 nm in thickness and the DLC film of the surface protection film is set to be 5 nm in thickness. The distance of the gap G is set to be 200 nm and the individual electrode 5 has a thickness of 100 nm.

A calculated value of the parameter (the ratio of a relative permittivity of the insulation film to a thickness thereof relating to the improvement in the pressure generated by the electrostatic actuator of the embodiment 8 is shown in the above Table 3.

Accordingly, the embodiment 8 can provide the same effects as in the embodiment 7 in terms of the pressure generated by the actuator, the insulation withstand voltage, the bonding strength and the driving durability.

As the advantage for disposing the DLC on the vibration plate side, there is a point that as compared with glass, silicon allows formation of a smoother film over an in-plane in an even state. Consequently, variations in actuator characteristics inside a wafer can be suppressed. Furthermore, as another advantage, when the vibration plate is processed into a thin plate for a purpose of reduction of an abutment voltage, disposing the DLC with a large stress on the vibration plate side facilitates obtaining of restitutive force necessary for separation of the vibration plate. Thus, the actuator can be driven at a low voltage.

EMBODIMENT 9

Figure 30:
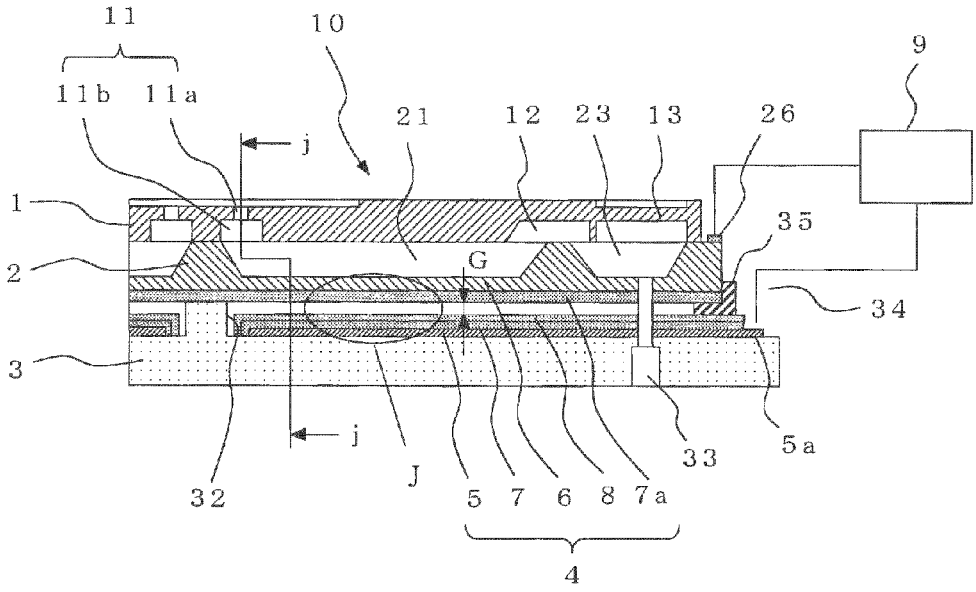
FIG. 30 A schematic sectional view of an inkjet head according to an embodiment 9 of the present invention.
Figure 31:
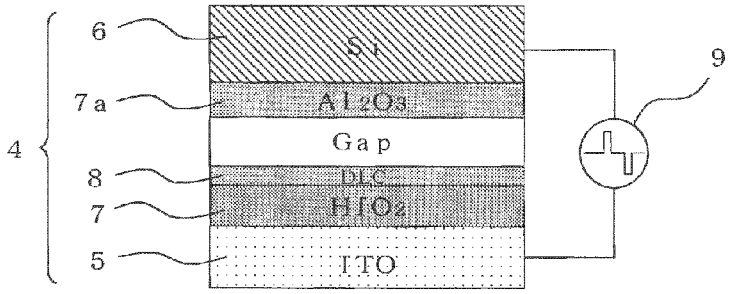
FIG. 31 An enlarged sectional view of part J of FIG. 30.
Figure 32:
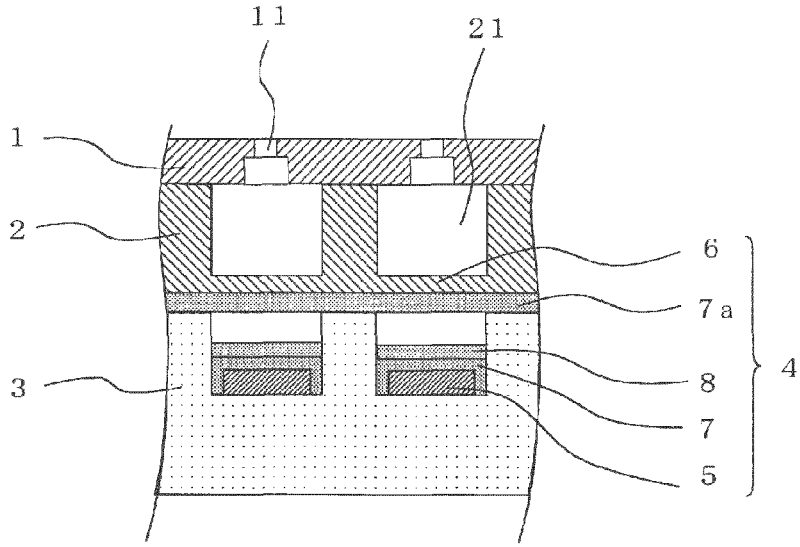
FIG. 32 A j-j enlarged sectional view of FIG. 30.

FIG. 30 is a schematic sectional view of an inkjet head 10 according to an embodiment 9 of the present invention, FIG. 31 is an enlarged sectional view of part J of FIG. 30, and FIG. 32 is a j-j enlarged sectional view of FIG. 30.

In an electrostatic actuator section 4 of the embodiment 9, hafnium oxide is used as the insulation film 7 on the individual electrode 5 side, and alumina is used as the second insulation film 7*a* on the vibration plate 6 side. The surface protection film 8 made of DLC is formed on the hafnium oxide film on the individual electrode 5 side.

Regarding film thicknesses, the alumina film on the individual electrode 5 side is set to be 40 nm in thickness, the alumina film on the vibration plate 6 side is set to be 100 nm in thickness, and the DLC film of the surface protection film is set to be 5 nm in thickness. The distance of the gap G is set to be 200 nm and the individual electrode 5 has a thickness of 100 nm.

A calculated value of the parameter (the ratio of a relative permittivity of the insulation film to a thickness thereof relating to the improvement in the pressure generated by the electrostatic actuator of the embodiment 9 is shown in the above Table 4. In the Table 4, each subscript 1 of t and ∈ indicates alumina and each subscript 2 indicates hafnium oxide and each subscript 3 indicates DLC. The conventional example is the same as that in the Table 2.

TABLE 4

| | Conventional Example ($SiO_2$: 110 nm) | Embodiments 7 and 8 ($Al_2O_3$: 100 nm, $HfO_2$: 40 nm, DLC: 5 nm) |
|---|---|---|
| $t/\epsilon$ $(t_1/\epsilon_1 + t_2/\epsilon_2 + t_3/\epsilon_3)$ | 28.95 | 16.29 |

In the electrostatic actuator of the embodiment 9, the insulation film 7 on the individual electrode 5 side is made of the hafnium oxide film and the second insulation film 7*a* on the vibration plate 6 side is made of the alumina film. Accordingly, as shown in the Table 4, the value of t/∈ can be significantly reduced. Therefore, the pressure generated by the actuator can be further improved.

Regarding the insulation withstand voltage, since the alumina film having the excellent insulation withstand voltage is disposed with the sufficient thickness, it is possible to ensure a necessary insulation withstand voltage.

Regarding the bonding strength, since the alumina film is disposed on the bonding portion, bonding strength minimally required as an actuator can be ensured.

Regarding the driving durability, since the DLC is used as the surface protection film, the driving durability can be significantly improved as in the embodiment 5.

EMBODIMENT 10

Figure 33:
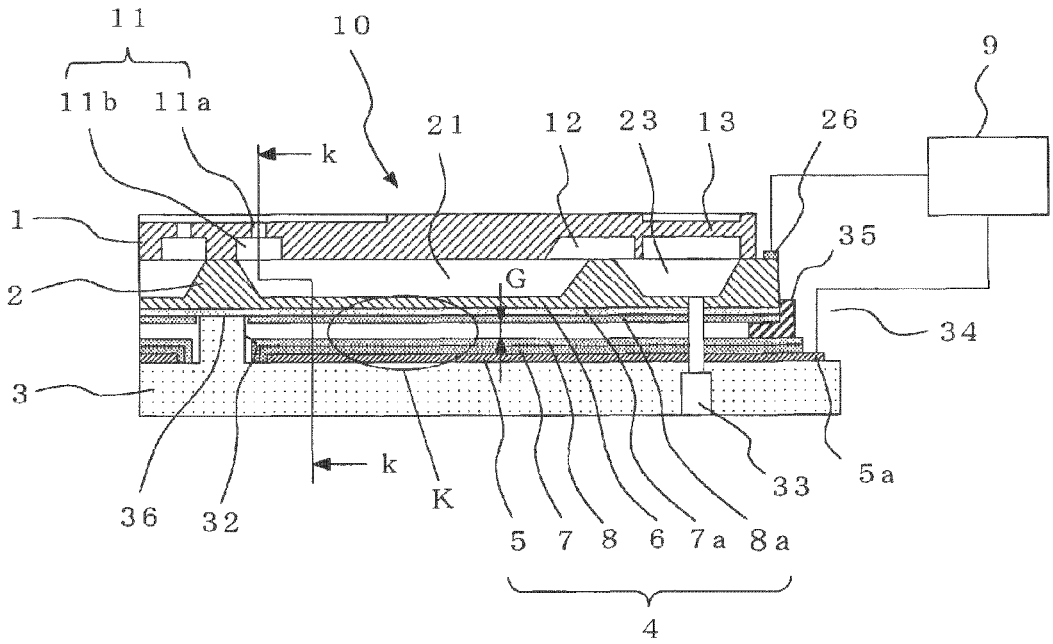
FIG. 33 A schematic sectional view of an inkjet head according to an embodiment 10 of the present invention.
Figure 34:
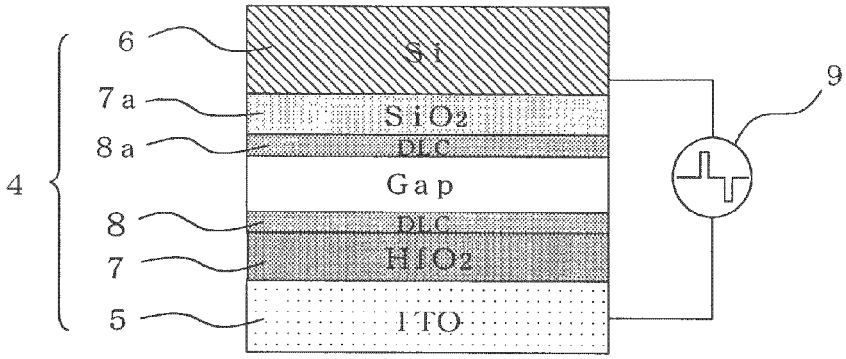
FIG. 34 An enlarged sectional view of part K of FIG. 33.
Figure 35:
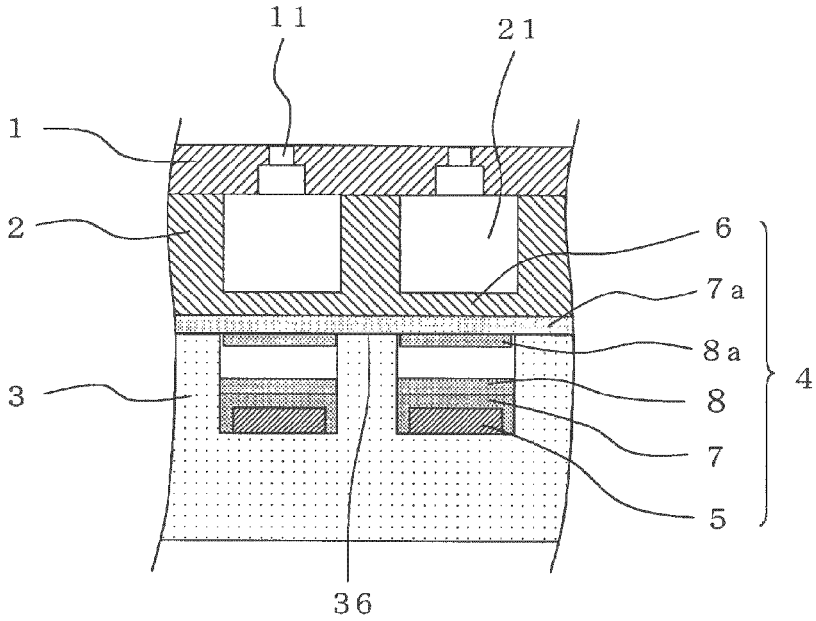
FIG. 35 A k-k enlarged sectional view of FIG. 33.

FIG. 33 is a schematic sectional view of an inkjet head 10 according to an embodiment 10 of the present invention, FIG. 34 is an enlarged sectional view of part K of FIG. 33 and FIG. 35 is a k-k enlarged sectional view of FIG. 33.

In an electrostatic actuator section 4 of the embodiment 10, hafnium oxide is used as the insulation film 7 on the individual electrode 5 side, and a silicon thermal oxide film is used as the second insulation film 7*a* on the vibration plate 6 side. The surface protection film 8 or 8*a* made of DLC is formed on either insulation film of the individual electrode 5 side and the vibration plate 6 side.

Regarding film thicknesses, the hafnium oxide film on the individual electrode 5 side is set to be 40 nm in thickness, the silicon thermal oxide film on the vibration plate 6 side is set to be 90 nm in thickness, and the DLC film of the surface protection film is set to be 5 nm in thickness, respectively. The distance of the gap G is set to be 200 nm and the individual electrode 5 has a thickness of 100 nm.

A calculated value of the parameter (the ratio of a relative permittivity of the insulation film to a thickness thereof relating to the improvement in the pressure generated by the electrostatic actuator of the embodiment 10 is shown in the above Table 5. In the Table 5, each subscript 1 of t and ∈ indicates silicon oxide and each subscript 2 indicates hafnium oxide and each subscript 3 indicates DLC. The conventional example is the same as that in the Table 2.

TABLE 5

| | Conventional Example ($SiO_2$: 110 nm) | Embodiment 10 ($SiO_2$: 90 nm, $HfO_2$: 40 nm, DLC: 10 nm) |
|---|---|---|
| $t/\epsilon$ $(t_1/\epsilon_1 + t_2/\epsilon_2 + t_3/\epsilon_3)$ | 28.95 | 28.40 |

In the case of the electrostatic actuator of the embodiment 10, particularly, the surface protection film 8 or 8*a* made of DLC is formed on either the insulation film 7 or 7*a*. Thus, since contact electrification phenomena are reduced without little problems, there is an effect that the driving durability is significantly improved.

Regarding the pressure generated by the actuator, the insulation withstand voltage and the bonding strength, the same effects can be obtained as those in the embodiment 7.

EMBODIMENT 11

Figure 36:
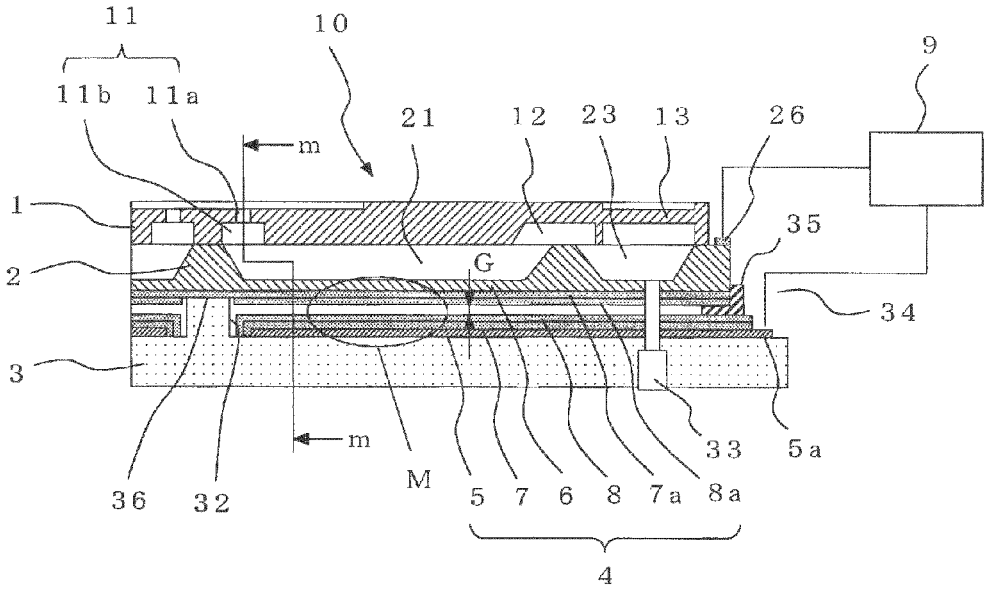
FIG. 36 A schematic sectional view of an inkjet head according to an embodiment 11 of the present invention.
Figure 37:
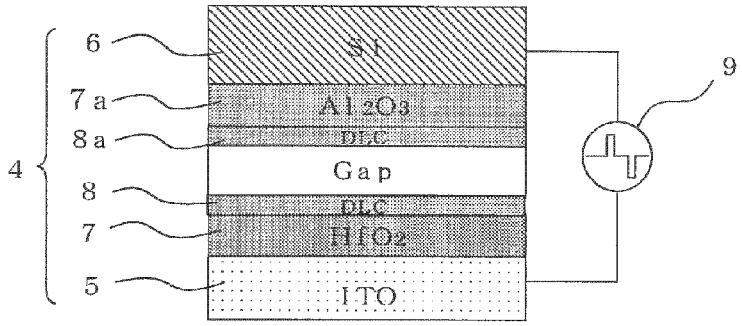
FIG. 37 An enlarged sectional view of part M of FIG. 36.

FIG. 36 is a schematic sectional view of an inkjet head 10 according to an embodiment 11 of the present invention, FIG. 37 is an enlarged sectional view of part M of FIG. 36, and FIG. 38 is an m-m enlarged sectional view of FIG. 36.

In an electrostatic actuator section 4 of the embodiment 11, hafnium oxide is used as the insulation film 7 on the individual electrode 5 side, and an alumina film is used as the second insulation film 7*a* on the vibration plate 6 side. That is, in the embodiment 11, in the insulating structure of the embodiment 9, the surface protection film 8 or 8*a* made of DLC is formed on either insulation film of the individual electrode 5 side and the vibration plate 6 side.

The surface protection film formed on the opposing surface of the vibration plate is the same kind of DLC as the surface protection film formed on the opposing surface of the individual electrode. Thus, it is possible to minimize an increase in static electricity of the actuator involving contact electrification due to driving of the actuator. Thus, the driving durability of the actuator can be improved.

Regarding film thicknesses, the hafnium oxide film on the individual electrode 5 side is set to be 40 nm in thickness, the alumina film on the vibration plate 6 side is set to be 120 nm in thickness, and the DLC film of the surface protection film is set to be 5 nm in thickness, respectively. The distance of the gap G is set to be 200 nm and the individual electrode 5 has a thickness of 100 nm.

A calculated value of the parameter (the ratio of a relative permittivity of the insulation film to a thickness thereof relating to the improvement in the pressure generated by the electrostatic actuator of the embodiment 10 is shown in the above Table 6. In the Table 6, each subscript 1 of t and ∈ indicates alumina and each subscript 2 indicates hafnium oxide and each subscript 3 indicates DLC. The conventional example is the same as that in the Table 2.

TABLE 6

| | Conventional Example ($SiO_2$: 110 nm) | Embodiment 11 ($Al_2O_3$: 120 nm, $HfO_2$: 40 nm, DLC: 10 nm) |
|---|---|---|
| $t/\epsilon$ $(t_1/\epsilon_1 + t_2/\epsilon_2 + t_3/\epsilon_3)$ | 28.95 | 20.10 |

In the electrostatic actuator of the embodiment 11, also, the surface protection film 8 or 8*a* made of DLC is formed on either the insulation film 7 or 7*a*. Therefore, its driving durability can be especially significantly improved.

Regarding the pressure generated by the actuator, the insulation withstand voltage and the bonding strength, the same effects can be obtained as those in the embodiment 9.

In the above embodiments 5 to 11, the structure is formed in which at least one of the individual electrode 5 side and the vibration plate 6 side has the insulation film made of the High-k material and the surface protection film made of DLC is formed thereon. Thus, the driving durability can be improved without reducing the pressure generated by the actuator. Therefore, still better characteristics can be exhibited than the structure of the combined silicon thermal oxide film and DLC as shown in the embodiments 1 to 4.

Next, FIG. 39 shows another method for manufacturing the electrode substrate 3 in the above embodiment 5. The manufacturing methods of the inkjet heads 10 in the embodiments 5 to 11 are basically the same as that shown in FIG. 17. Thus, an outline will be explained using FIG. 17.

In FIG. 39, the manufacturing process of the individual electrode 5 of (a) is approximately the same as that in FIG. 16(*a*). Then, as shown in FIG. 39(*b*), as the insulation film 7 on the individual electrode 5 side, an alumina film is formed with a preferable thickness on an entire surface of a bonding-surface side of a glass substrate 300 by an ECR (Electron Cyclotron Resonance) sputtering method. Next, a DLC film having a preferable thickness is deposited on an entire surface of the alumina film by a parallel-plate-type RF-CVD method using toluene gas as a raw material gas.

Next, as shown in FIG. 39(*c*), the bonding portion 36 of the glass substrate 300 and only a portion corresponding to the terminal portion 5*a* of the individual electrode 5 are patterned and the DLC films on those portions are removed by $O_2$ ashing. After the removal of the DLC films, furthermore, the alumina films of those portions are removed by RIE (Reactive Ion Etching) dry etching with $CHF_3$. After that, the hole portion 33*a* that becomes the ink supplying hole 33 is formed by blast processing or the like.

In the above manner, the electrode substrate 3 of the embodiment 5 can be manufactured.

In the embodiment 7, the above method can be used, whereas in the embodiments 6 and 8, it is only necessary to form the alumina film on the individual electrode 5 side. Additionally, in the cases of the embodiments 9 to 11, the hafnium oxide film is formed on the individual electrode 5 side by the above same method and additionally the DLC film as the surface protection film is formed thereon.

In the above manner, the electrode substrate 3 employed in the embodiments 6 to 11 can be manufactured.

Regarding the manufacturing of the cavity substrate 2, in the embodiments 5 and 9 the alumina film may be deposited entirely on an undersurface of the boron diffusion layer 201 of the silicon substrate 200 shown in FIG. 14(*a*) by the ECR (Electron Cyclotron Resonance) sputtering method.

In the embodiments 6 and 11, after depositing the alumina film entirely on the undersurface of the boron diffusion layer 201, the DLC film may be deposited entirely thereon. Then additionally, a region corresponding to the bonding portion 36 may be patterned in a slightly large size and the DLC film of the region may be removed by $O_2$ ashing.

In the embodiment 7, after the formation of the boron diffusion layer 201, the entire silicon substrate 200 may be thermally oxidized.

In the embodiments 8 and 10, after the thermal oxidization of the silicon substrate 200 as described above, the DLC film may be deposited entirely on the silicon thermal oxide film of the bonding surface side. Then, additionally, the region corresponding to the bonding portion 36 may be patterned in a slightly large size and the DLC film of the region may be removed by $O_2$ ashing.

After that, the main body section of the inkjet head 10 of each of the embodiments 5 to 11 can be manufactured through the steps shown in FIGS. 14(*b*) to (*g*).

The above embodiments have described the electrostatic actuator and the inkjet head, as well as the manufacturing methods of them. The present invention, however, is not restricted to the above embodiments. Various modifications can be made within the scope of idea of the present invention. For example, the electrostatic actuator of the present invention can also be applied to an optical switch, a mirror device, a micro pump, a driving unit of a laser operation mirror of a laser printer and the like. Furthermore, by changing a liquid material discharged from the nozzle holes, other than an inkjet printer, it can be used as a liquid droplet discharging apparatus for various purposes, such as manufacturing of a color filter of a liquid crystal display, formation of a light emitting section of an organic EL display device and manufacturing of a microarray of biomolecular solution used in gene testing or the like.

Figure 40:
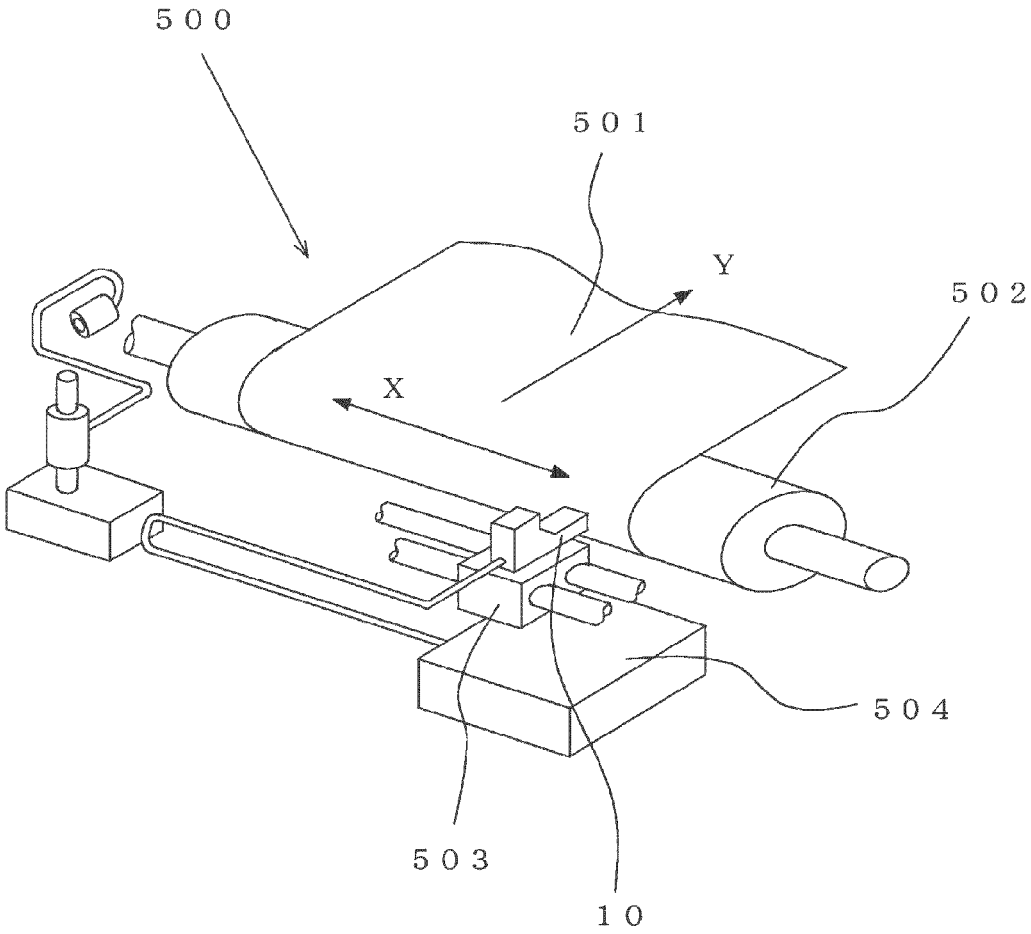
FIG. 40 A schematic perspective view for showing an example of an inkjet printer applying the inkjet head of the present invention.

For example, FIG. 40 shows an outline of an inkjet printer including the inkjet head of the present invention.

The inkjet printer 500 has a platen 502 for feeding a recording sheet 501 in a sub-scanning direction Y, the inkjet head 10 whose ink nozzle faces confront the platen 502, a carriage 503 for reciprocating the inkjet head 10 in a main scanning direction X and an ink tank 504 for supplying ink to each ink nozzle of the inkjet head 10.

Therefore, the inkjet printer can achieve high resolution and high-speed driving.

EXPLANATION OF THE NUMERALS

1: nozzle substrate, 2: cavity substrate, 3: electrode substrate, 4: electrostatic actuator section, 5: individual electrode (fixed electrode), 6: vibration plate (movable electrode), 7: insulation film, 7*a*: second insulation film, 8: surface protection film, 8*a*: second surface protection film, 9: drive control circuit (driving means), 10: inkjet head, 11: nozzle hole, 12: orifice, 13: diaphragm section, 21: discharging chamber, 23: reservoir, 26: common electrode, 27: silicon oxide film, 32: recessed portion, 33: ink supplying hole, 34: electrode extraction portion, 35: sealant, 36: bonding portion, 200: silicon substrate, 300: glass substrate, and 500: inkjet printer.

The invention claimed is:

1. An electrostatic actuator including a fixed electrode formed on a substrate, a movable electrode arranged opposite to the fixed electrode via a predetermined gap and a driving means for causing a displacement of the movable electrode by generating an electrostatic force between the fixed electrode and the movable electrode, the electrostatic actuator characterized by comprising:

an insulation film provided on one or both of opposing surfaces of the fixed electrode and the movable electrode and a surface protection film provided on the insulation film, the surface protection film being made of a hard ceramic film or a hard carbon film, wherein when the insulation film and the surface protection film are not provided on the opposing surface of the movable electrode, a second insulation film is provided on the opposing surface thereof, and wherein at least one of the insulation film and the second insulation film is a dielectric material having a relative permittivity higher than that of silicon oxide.

2. The electrostatic actuator as described in claim 1, characterized by that the surface protection film is made of a carbon material such as diamond or diamond-like carbon.

3. The electrostatic actuator as described in claim 1, characterized by that when the insulation film and the surface protection film are not provided on the opposing surface of the fixed electrode, a second insulation film is provided on the opposing surface thereof.

4. The electrostatic actuator as described in claim 1, characterized by that the substrate on which the fixed electrode is formed is a glass substrate.

5. The electrostatic actuator as described in claim 1, characterized by that at least one of the insulation film and the second insulation film is a silicon oxide film.

6. The electrostatic actuator as described in claim 1, characterized by that as the dielectric material having the relative permittivity higher than silicon oxide, at least one is selected from aluminum oxide ($Al_2O_3$), hafnium oxide ($HfO_2$), hafnium silicate nitride (HfSiN) and hafnium silicate oxynitride (HfSiON).

7. A liquid droplet discharging head including a nozzle substrate having a single or a plurality of nozzle holes for discharging a liquid droplet, a cavity substrate on which a recessed portion is formed that becomes a discharging chamber communicating with each of the nozzle holes between the nozzle substrate and the cavity substrate, and the electrode substrate on which an individual electrode as the fixed electrode is arranged opposite to a vibration plate as the movable electrode formed by a bottom portion of the discharging chamber via the predetermined gap, the liquid droplet discharging head comprising the electrostatic actuator as described in claim 1.

8. A liquid droplet discharging apparatus characterized by comprising the liquid droplet discharging head as described in claim 7.

* * * * *